US009098067B2

(12) United States Patent
Koda et al.

(10) Patent No.: US 9,098,067 B2
(45) Date of Patent: Aug. 4, 2015

(54) ESCAPEMENT, TIMEPIECE MOVEMENT AND TIMEPIECE

(71) Applicant: SEIKO INSTRUMENTS INC., Chiba-shi, Chiba (JP)

(72) Inventors: Masayuki Koda, Chiba (JP); Shigeo Suzuki, Chiba (JP); Hisashi Fujieda, Chiba (JP)

(73) Assignee: SEIKO INSTRUMENTS INC. (JP)

( * ) Notice: Subject to any disclaimer, the term of this patent is extended or adjusted under 35 U.S.C. 154(b) by 0 days.

(21) Appl. No.: 14/338,772

(22) Filed: Jul. 23, 2014

(65) Prior Publication Data

US 2015/0029827 A1 Jan. 29, 2015

(30) Foreign Application Priority Data

Jul. 25, 2013 (JP) ..... 2013-154978

(51) Int. Cl.
*G04B 15/08* (2006.01)
*G04B 15/14* (2006.01)

(52) U.S. Cl.
CPC ..... *G04B 15/08* (2013.01); *G04B 15/14* (2013.01)

(58) Field of Classification Search
CPC ..... G04B 15/14; G04B 15/08
USPC ..... 368/132, 127, 129, 133
See application file for complete search history.

(56) References Cited

U.S. PATENT DOCUMENTS 4,122,665 A * 10/1978 Giger ..... 368/327
8,591,101 B2 * 11/2013 Hiraoka et al. ..... 368/132
8,783,943 B2 * 7/2014 Koda et al. ..... 368/127

FOREIGN PATENT DOCUMENTS

EP 0018796 12/1980

* cited by examiner

*Primary Examiner* — Edwin A. Leon
(74) *Attorney, Agent, or Firm* — Adams & Wilks

(57) ABSTRACT

An object is to provide an escapement which can improve energy transmission efficiency, a timepiece movement including the escapement, and a timepiece including the timepiece movement. There is provided an escapement 1 including an escape wheel 11, a double roller 53 that is disposed in a balance 5 pivotally moving around a balance staff 51, and a pallet fork 12 that can pivotally move around a pallet staff 33. The double roller 53 includes a first impulse pin 57 which comes into contact with the pallet fork 12 in response to a pivotal movement of the double roller 53 and causes the pallet fork 12 to pivotally move around the pallet staff 33, and a second impulse pin 58 which can come into contact with tooth portion 23 of the escape wheel 11. The pallet fork 12 includes two pallets of an entry pallet 45 and an exit pallet 38.

14 Claims, 20 Drawing Sheets

ESCAPEMENT, TIMEPIECE MOVEMENT AND TIMEPIECE

BACKGROUND OF THE INVENTION

1. Field of the Invention

The present invention relates to an escapement, and to a timepiece movement and a timepiece which include the escapement.

2. Description of the Related Art

In general, a mechanical timepiece includes an escapement for controlling rotation of a barrel wheel, a center wheel & pinion, a third wheel & pinion and a second wheel & pinion which configure a front train wheel. The escapement mainly includes an escape wheel, a double roller disposed in a balance which pivotally moves around a balance staff, and a pallet fork which is pivotally movable around a pallet staff.

The double roller includes an impulse pin which comes into contact with the pallet fork, and pivotally moves together with the balance by using energy accumulated in a hairspring. The pallet fork includes an entry pallet and an exit pallet which can disengage from a tooth portion of the escape wheel, and pivotally moves around the pallet staff by the energy of the hairspring being transmitted to the pallet fork via the impulse pin.

If the pallet fork pivotally moves around the pallet staff, the entry pallet and the exit pallet alternately disengage from the tooth portion of the escape wheel. When the entry pallet and the exit pallet of the pallet fork engage with the tooth portion of the escape wheel, rotation of the escape wheel is temporarily stopped. In addition, when the entry pallet and the exit pallet disengage from the tooth portion of the escape wheel, the escape wheel is rotated. These operations are continuously repeated so that the mechanical timepiece tells time.

Incidentally, in general, the energy of the hairspring is provided from a mainspring accommodated in the barrel wheel via the front train wheel and the escapement.

For example, European Patent Application Publication No. 0018796 (Patent Document 1) discloses the escapement including the escape wheel having an escape pinion, the pallet fork having the entry pallet, the exit pallet and a third pallet (pallet 26), and the double roller having a first impulse pin and a second impulse pin (pallet 25). According to a technology disclosed in Patent Document 1, when the balance and the double roller pivotally move clockwise, the tooth portion of the escape wheel comes into contact with the second impulse pin so as to provide the hairspring with the energy. In addition, when the balance and the double roller pivotally move counterclockwise, the escape pinion of the escape wheel comes into contact with the third pallet so as to provide the hairspring with the energy via the pallet fork.

However, in the related art, it is necessary to dispose the third pallet coming into contact with the escape pinion in the pallet fork. Therefore, there is a tendency that the pallet fork is increased in size. In addition, in order to enable the escape pinion and the third pallet to come into contact with each other, there is a tendency that the escape pinion is increased in size. This increases viscosity frictional resistance when the pallet fork and the escape wheel pivotally move. In addition, since the increased size of the pallet fork and the escape wheel increases a weight thereof, solid frictional resistance in the pallet staff or a bearing of an axle portion of the escape wheel increases. This increase in the viscosity frictional resistance and the solid frictional resistance causes energy loss in the escapement.

Furthermore, the increased weight of the pallet fork and the escape wheel increases the moment of inertia. Consequently, a movement becomes slow when the pallet fork and the escape wheel pivotally move. This narrows an impact range when the pallet fork and the escape wheel collide with the impulse pin, and thus it is not possible to efficiently transmit the energy.

As described above, in the related art, there is a problem in that energy transmission efficiency in the escapement needs to be improved by virtue of the increased size and the increased weight of the pallet fork and the escape wheel.

SUMMARY OF THE INVENTION

Therefore, the present invention aims to provide an escapement which can improve energy transmission efficiency, a timepiece movement including the escapement, and a timepiece including the timepiece movement.

In order to solve the above-described problem, an escapement of the present invention includes an escape wheel, a double roller that is disposed in a balance pivotally moving around a balance staff, and a pallet fork that can pivotally move around a pallet staff. The double roller includes a first impulse pin which comes into contact with the pallet fork in response to a pivotal movement of the double roller and causes the pallet fork to pivotally move around the pallet staff, and a second impulse pin which can come into contact with a tooth portion of the escape wheel. The pallet fork includes two pallets.

According to the present invention, the pallet fork includes two pallets. Therefore, as compared to the related art including three pallets, one pallet can be reduced and a space for fixing the reduced pallet can be reduced. In addition, as compared to the related art, the pallet and an escape pinion do not need to come into contact with each other. Therefore, it is possible to decrease the escape pinion in diameter. This enables the pallet fork and the escape wheel to be decreased in size and in weight. Accordingly, it is possible to decrease viscosity frictional resistance and solid frictional resistance when the pallet fork and the escape wheel pivotally move. In addition, the decreased weight of the pallet fork and the escape wheel decreases the moment of inertia compared to the related art. Therefore, the pallet fork can pivotally and quickly move. In this manner, an impact range is widened when the pallet fork collides with the first impulse pin and the escape wheel collides with the second impulse pin. Accordingly, it is possible to efficiently transmit the energy. As described above, it is possible to improve the energy transmission efficiency from the escape wheel to the balance by virtue of the decreased size and the decreased weight of the pallet fork and the escape wheel.

In addition, the double roller includes the first impulse pin which comes into contact with the pallet fork in response to the pivotal movement of the double roller and causes the pallet fork to pivotally move around the pallet staff, and the second impulse pin which can come into contact with the tooth portion of the escape wheel. Therefore, for example, even in a case of the escapement which needs lubrication for the pallet and the tooth portion of the escape wheel, it is possible to suppress oil spreading to a contact portion between the first impulse pin and the pallet fork. Accordingly, it is possible to ensure a stable operation of a speed regulator including the escapement and the balance by preventing oil adhesion or an increase in viscosity resistance caused by deterioration of adhering oil. Therefore, it is possible to prevent timing accuracy from being deteriorated.

Furthermore, without depending on a position of the first impulse pin, it is possible to set a desired position of the second impulse pin, a desired outer diameter of the escape wheel, and a desired separating distance between the balance staff and the rotation center of the escape wheel. In this manner, it is possible to set a desired impact range when the tooth portion of the escape wheel and the second impulse pin collide with each other. Therefore, it is possible to set a desired balance between the energy transmission efficiency of the escapement and the timing accuracy.

In addition, the two pallets are a first pallet and a second pallet which can disengage from the tooth portion of the escape wheel in response to a pivotal movement of the pallet fork and cause the escape wheel to be rotated and stopped. A distal end of the second pallet has a sliding surface which intersects a circumferential direction of the escape wheel and on which the tooth portion of the escape wheel is slidable during rotation of the escape wheel. When the double roller pivotally moves to one side in the circumferential direction of the balance staff, the first pallet and the escape wheel are disengaged from each other, and the tooth portion of the escape wheel and the second impulse pin come into contact with each other. When the double roller pivotally moves to the other side in the circumferential direction, the second pallet and the escape wheel are disengaged from each other, and the tooth portion of the escape wheel slides on the sliding surface.

According to the present invention, when the double roller pivotally moves to one side, the first pallet and the escape wheel are disengaged from each other, and the tooth portion of the escape wheel and the second impulse pin come into contact with each other. Accordingly, it is possible to provide the energy by directly applying an impact to the second impulse pin from the escape wheel. In addition, when the double roller pivotally moves to the other side, the second pallet and the escape wheel are disengaged from each other, and the tooth portion of the escape wheel is caused to slide on the sliding surface. Therefore, it is possible to cause the pallet fork to pivotally move around the pallet staff by moving the second pallet. Accordingly, it is possible to provide the energy by applying the impact to the first impulse pin from the escape wheel via the pallet fork.

In addition, the pallet fork includes a first pallet fork body which holds the first pallet and the second pallet, and a second pallet fork body which is disposed to be overlapped with the first pallet fork body in an axial direction of the balance staff and can come into contact with the first impulse pin.

According to the present invention, the first pallet fork body which holds the first pallet and the second pallet and the second pallet fork body which can come into contact with the first impulse pin are disposed to be overlapped with each other in the axial direction of the balance staff. In this manner, a position where the first pallet and the second pallet come into contact with the tooth portion of the escape wheel and a position where the pallet fork comes into contact with the first impulse pin are deviated from each other in the axial direction of the balance staff. Therefore, for example, even when lubricating the second pallet having the sliding surface, it is possible to reliably suppress the oil spreading to a contact portion between the first impulse pin and the pallet fork. In addition, in the axial direction, the first pallet fork body can be arranged at a position corresponding to the tooth portion of the escape wheel, and the second pallet fork body can be arranged at a position corresponding to the first impulse pin. Accordingly, the first pallet and the second pallet which are held by the first pallet fork body can be prevented from being lengthened in the axial direction. This enables the first pallet and the second pallet to be decreased in weight, and it is possible to reduce the bending moment acting on the first pallet and the second pallet when the first pallet and the second pallet come into contact with the tooth portion of the escape wheel. Therefore, it is possible to provide an excellent escapement which can achieve both of a decreased weight and improved durability.

In addition, the escape wheel includes a first escape wheel portion and a second escape wheel portion which is disposed to be overlapped with the first escape wheel portion in the axial direction of the balance staff. The tooth portion of the escape wheel includes a first tooth portion which is formed in the first escape wheel portion and a second tooth portion which is formed in the second escape wheel portion. At least the second impulse pin can come into contact with the first tooth portion, and at least the second pallet can disengage from the second tooth portion.

According to the present invention, the first escape wheel portion and the second escape wheel portion are disposed to be overlapped with each other in the axial direction, at least the second impulse pin can come into contact with the first tooth portion of the first escape wheel portion, and at least the second pallet can disengage from the second tooth portion of the second escape wheel portion. Therefore, in the axial direction, the second impulse pin can be arranged at a position corresponding to the first tooth portion of the first escape wheel portion, and the second pallet can be arranged at a position corresponding to the second tooth portion of the second escape wheel portion. This can prevent the second impulse pin held by the double roller and the second pallet held by the pallet fork from being lengthened in the axial direction. Accordingly, it is possible to decrease the weight of the second impulse pin and the second pallet, and it is possible to reduce the bending moment acting on the second impulse pin and the second pallet when the second impulse pin and the second pallet come into contact with the tooth portion of the escape wheel.

In addition, the second escape wheel portion is adapted to have a diameter smaller than that of the first escape wheel portion. Accordingly, it is possible to further increase a torque generated in the pallet fork as compared to a torque generated in the second escape wheel portion. In addition, the decreased weight of the second pallet can reduce the moment of inertia of the pallet fork. Therefore, when the energy is provided by applying the impact to the first impulse pin from the escape wheel via the pallet fork, it is possible to improve the energy transmission efficiency.

In addition, the first tooth portion of the first escape wheel portion and the second tooth portion of the second escape wheel portion can be adapted to have different shapes which are suitable for the respective tooth portions. Therefore, it is possible to improve strength of the first tooth portion of the first escape wheel portion and the second tooth portion of the second escape wheel portion.

In addition, the first tooth portion of the first escape wheel portion with which the second impulse pin comes into contact and the second tooth portion of the second escape wheel portion from which the second pallet disengages are disposed at positions respectively deviated from each other in the axial direction. Therefore, for example, even in the escapement requiring lubrication in the pallet fork and the tooth portion of the escape wheel, it is possible to reliably suppress the oil spreading to the contact portion between the first impulse pin and the pallet fork, and it is also possible to reliably suppress the oil spreading to the second impulse pin.

The tooth portion of the escape wheel has a first tooth portion, and a second tooth portion which extends along the axial direction of the balance staff, and at least the second impulse pin can come into contact with the first tooth portion, and at least the second pallet can disengage from the second tooth portion.

According to the present invention, the second tooth portion extends along the axial direction. Therefore, as compared to a case where the second tooth portion is formed as a gear, it is possible to decrease the weight of the second tooth portion. This can reduce the moment of inertia of the escape wheel. Accordingly, it is possible to improve the energy transmission efficiency from the escape wheel to the balance.

In addition, it is possible to easily set a separating distance of the second tooth portion by adjusting a thickness of the second tooth portion. Therefore, it is possible to easily ensure a clearance between the second pallet and the second tooth portion. Accordingly, it is possible to provide the escape wheel which is excellent in design flexibility.

In addition, the second tooth portion has an impact surface on which the second pallet slides after the second tooth portion of the escape wheel slid on the sliding surface of the second pallet in response to the rotation of the escape wheel.

According to the present invention, the second tooth portion slides on the sliding surface of the second pallet, and thereafter the second pallet further slides on the impact surface of, the second tooth portion. In this manner, it is possible to apply a large torque to the balance via the pallet fork. Consequently, the energy transmitted to the balance can be further improved by the escape wheel which has both of the first tooth portion and the second tooth portion which can apply a direct impact to the above-described second impulse pin.

In addition, the double roller includes a first double roller body which holds the first impulse pin, and a second double roller body which is disposed to be overlapped with the first double roller body in the axial direction of the balance staff and holds the second impulse pin.

According to the present invention, the double roller includes the first double roller body which holds the first impulse pin, and the second double roller body which holds the second impulse pin. Therefore, it is possible to distribute stress when the first impulse pin comes into contact with the pallet fork and stress when the second impulse pin comes into contact with the tooth portion of the escape wheel, respectively to the first double roller body and the second double roller body. In addition, for example, even when the first impulse pin and the second impulse pin are fixed to the double roller by way of press-fitting and further the double roller is fixed to the balance staff by way of the press-fitting, it is possible to distribute the stress generated during the press-fitting to the first double roller body and the second double roller body. Accordingly, it is possible to ensure rigidity of the double roller, and it is possible to provide the escapement which is excellent in the durability.

In addition, the pallet fork includes a pallet receptacle whose inner surface can come into contact with the first impulse pin, and a blade tip which extends from an inner side of the pallet receptacle toward the double roller. A retaining rib with which the blade tip comes into sliding contact is disposed in the double roller.

According to the present invention, the pallet fork includes the retaining rib with which the blade tip comes into sliding contact. Therefore, even when the first impulse pin disengages from the pallet receptacle, it is possible to prevent the pallet fork from pivotally moving. Accordingly, it is possible to prevent an abnormal operation, so-called shaking, in which the first impulse pin comes into contact with an outer side surface of the pallet receptacle after the first impulse pin disengages from the pallet receptacle, the movement of the first impulse pin is hindered by the pallet fork, and the pivotal movement of the balance is stopped.

In addition, a meshing amount of the first pallet and the second pallet with the tooth portion of the escape wheel is ensured so as to obtain a predetermined required amount or more. In this manner, it is possible to prevent the following abnormal operation, so-called a semi-shaking phenomenon. In an operating state where the first pallet and the second pallet are not supposed to disengage from the tooth portion of the escape wheel in the originally planned operation of the escapement, for example, in a state where the first impulse pin is not supposed to enter the pallet receptacle, strong disturbance causes the first pallet and the second pallet to disengage from the tooth portion of the escape wheel, and the escape wheel falls on the sliding surface of the second pallet, for example. The impact is transmitted from the escape wheel to the pallet fork and the pallet fork is caused to pivotally move. Consequently, a stag beetle-shaped portion presses the first impulse pin. In addition, the blade tip presses the retaining rib. Consequently, the balance is pressed by the pallet fork in the radial direction of the balance, and the pivotal movement of the balance is eventually stopped.

In addition, the tooth portion of the escape wheel has a contact surface which comes into contact with the pallet. The pallet has an engagement surface which engages with the contact surface of the escape wheel. When viewed from the axial direction of a rotation center of the escape wheel, a straight line connecting a central axis of the pallet staff with a tooth tip of the tooth portion of the escape wheel is set to be a first straight line, and a straight line orthogonal to the first straight line is set to be a second straight line. When the contact surface of the escape wheel and the engagement surface of the pallet engage with each other, the engagement surface of the pallet is tilted with respect to the second straight line at a predetermined angle in a rotating direction of the escape wheel.

According to the present invention, the engagement surface of the pallet is tilted with respect to the second straight line at the predetermined angle in the rotating direction of the escape wheel. Therefore, if the tooth portion of the escape wheel and the pallet engage with each other, a torque acts on the pallet so that the rotation torque of the escape wheel draws the pallet into the escape wheel side. In this manner, it is possible to stabilize an engagement state between the tooth portion of the escape wheel and the pallet. Therefore, for example, it is possible to prevent the engagement position of the first pallet and the second pallet with the tooth portion of the escape wheel from being deviated due to the disturbance. Accordingly, it is possible to prevent an abnormal operation where the pallet fork is caused to pivotally move due to the disturbance, the retaining rib and the blade tip come into contact with each other to interfere with the balance, and consequently free vibration of the balance is hindered.

In addition, a timepiece movement of the present invention includes the above-described escapement. In addition, a timepiece of the present invention includes the above-described timepiece movement.

According to the present invention, it is possible to provide the high-performance timepiece movement and the high-performance timepiece which can improve the energy transmission efficiency and are excellent in the timing accuracy.

According to the present invention, the pallet fork includes two pallets. Therefore, as compared to the pallet fork in the related art including three pallets, one pallet can be reduced and a space for fixing the reduced pallet can be reduced. In addition, as compared to the related art, the pallet and an escape pinion do not need to come into contact with each other. Therefore, it is possible to decrease the escape pinion in diameter. This enables the pallet fork and the escape wheel to be decreased in size and in weight. Accordingly, it is possible to decrease viscosity frictional resistance and solid frictional resistance when the pallet fork and the escape wheel pivotally move. In addition, the decreased weight of the pallet fork and the escape wheel decreases the moment of inertia compared to the related art. Therefore, the pallet fork can pivotally and quickly move. In this manner, an impact range is widened when the pallet fork collides with the first impulse pin and the escape wheel collides with the second impulse pin. Accordingly, it is possible to efficiently transmit the energy. As described above, it is possible to improve the energy transmission efficiency from the escape wheel to the balance by virtue of the decreased size and the decreased weight of the pallet fork and the escape wheel.

In addition, the double roller includes the first impulse pin which comes into contact with the pallet fork in response to the pivotal movement of the double roller and causes the pallet fork to pivotally move around the pallet staff, and the second impulse pin which can come into contact with tooth portion of the escape wheel. Therefore, for example, even in the escapement requiring lubrication in the pallet and the tooth portion of the escape wheel, it is possible to suppress the oil spreading to the contact portion between the first impulse pin and the pallet fork. Accordingly, it is possible to ensure a stable operation of a speed regulator including the escapement and the balance by preventing oil adhesion or an increase in viscosity resistance caused by deterioration of adhering oil. Therefore, it is possible to prevent timing accuracy from being deteriorated.

Furthermore, without depending on a position of the first impulse pin, it is possible to set a desired position of the second impulse pin, a desired outer diameter of the escape wheel, and a desired separating distance between the balance staff and the rotation center of the escape wheel. In this manner, it is possible to set a desired impact range when the tooth portion of the escape wheel and the second impulse pin collide with each other. Therefore, it is possible to set a desired balance between the energy transmission efficiency of the escapement and the timing accuracy.

DETAILED DESCRIPTION OF THE PREFERRED EMBODIMENTS

First Embodiment

Hereinafter, an embodiment of the present invention will be described with reference to the drawings.

Herein, a mechanical timepiece according to the embodiment will be first described, and then an escapement will be described in detail.

In general, a machine body including a driving portion of a timepiece is referred to as a "movement". A state of a finished product by attaching a dial and hands to the movement and placing the movement in a timepiece case is referred to as a "complete assembly" of the timepiece. Between both sides of a main plate configuring a substrate of the timepiece, a side having glass of the timepiece case, that is, a side having the dial is referred to as a "rear side" of the movement. Between both sides of the main plate, a side having a rear cover of the timepiece case, that is, a side opposite to the dial is referred to as a "front side" of the movement.

Figure 1:
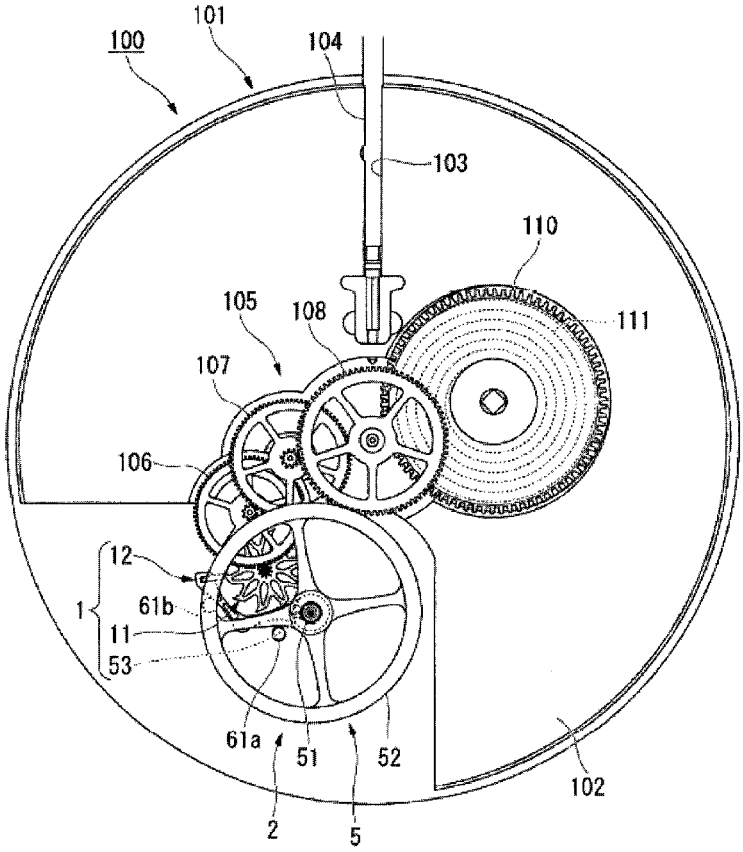
FIG. 1 is a plan view when a timepiece movement is viewed from a front side.

FIG. 1 is a plan view when a movement 101 of a timepiece 100 (corresponding to a "timepiece movement" in claims) is viewed from a front side.

As illustrated in FIG. 1, the timepiece 100 includes the movement 101. The movement 101 has a main plate 102 configuring a substrate. A winding stem guide hole 103 is formed in the main plate 102. A winding stem 104 is rotatably assembled inside the winding stem guide hole 103.

A switching device (not illustrated) including a setting lever, a yoke and a yoke holder is arranged in a rear side of the movement 101 (back side of the paper surface in FIG. 1). This switching device determines an axial position of the winding stem 104.

A second wheel & pinion 106, a third wheel & pinion 107, a center wheel & pinion 108 and a barrel wheel 110 which configure a front train wheel 105 are arranged and an escapement 1 and speed regulator 2 which control rotation of the front train wheel 105 are arranged on a front side of the movement 101 (front side of the paper surface in FIG. 1).

The barrel wheel 110 has a mainspring 111. If the winding stem 104 is rotated, a clutch wheel (not illustrated) is rotated, and the mainspring 111 is wound up via a winding pinion, a crown wheel and a ratchet wheel (all are not illustrated). Then, the barrel wheel 110 is rotated by rotation force generated when the mainspring 111 is unwound, and further the center wheel & pinion 108 is rotated.

The center wheel & pinion 108 has a center pinion meshing with a barrel gear (not illustrated) of the barrel wheel 110 and a center gear (all are not illustrated). If the center wheel & pinion 108 is rotated, the third wheel & pinion 107 is rotated.

The third wheel & pinion 107 has a third pinion (not illustrated) meshing with the center gear of the center wheel & pinion 108 and a third gear (all are not illustrated). If the third wheel & pinion 107 is rotated, the second wheel & pinion 106 is rotated.

The second wheel & pinion 106 has a second pinion (not illustrated) meshing with the third gear of the third wheel & pinion 107 and a second gear (all are not illustrated). The second wheel & pinion 106 is rotated, thereby driving the escapement 1 and the speed regulator 2.

The escapement 1 includes an escape wheel 11 meshing with the second wheel & pinion 106 and a pallet fork 12 which escapes the escape wheel 11 to be regularly rotated.

The speed regulator 2 is a mechanism for regulating the speed of the escapement 1, and has a balance 5.

Then, the escapement 1 and the speed regulator 2 are driven, thereby controlling the second wheel & pinion 106 to be rotated once per minute and controlling the center wheel & pinion 108 to be rotated once per hour.

(Escapement)

Subsequently, the escapement 1 will be described.

Figure 2:
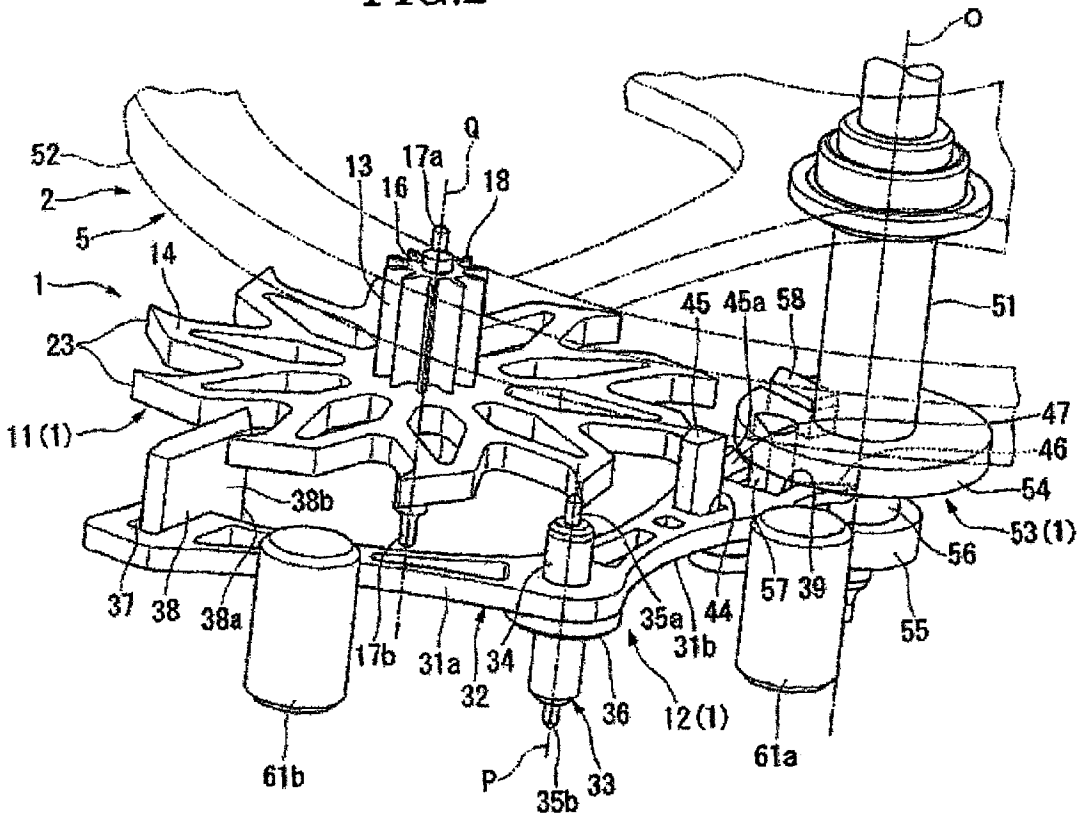
FIG. 2 is a perspective view of an escapement.
Figure 3:
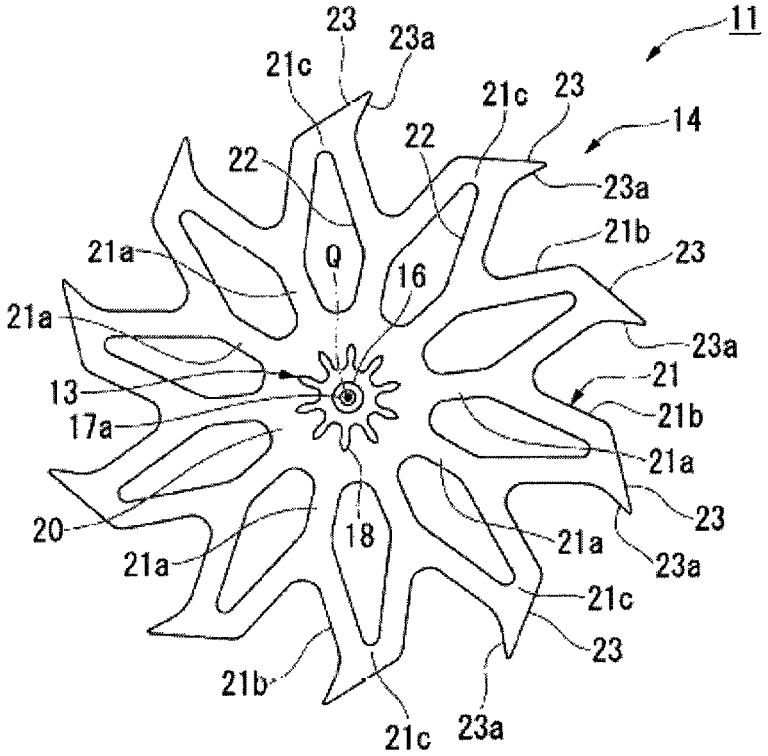
FIG. 3 is a plan view of an escape wheel.

FIG. 2 is a perspective view of the escapement 1. FIG. 3 is a plan view of the escape wheel 11 when viewed from a front side of the movement 101 (refer to FIG. 1). In FIG. 2, a balance wheel 52 is illustrated by a two-dot chain line.

As illustrated in FIG. 2, the escapement 1 includes the escape wheel 11, a double roller 53 and the pallet fork 12.

The escape wheel 11 includes an axle portion 13 and an escape wheel portion 14 which is externally and fixedly fitted to the axle portion 13.

The axle portion 13 has an axle portion body 16. In the axle portion body 16, a first tenon portion 17*a* is integrally formed in an end portion of a front side (upper side in FIG. 2) of the movement 101 (refer to FIG. 1), and a second tenon portion 17*b* is integrally formed in an end portion of a rear side (lower side in FIG. 2) of the movement 101 (refer to FIG. 1). An axle diameter of the first tenon portion 17*a* and an axle diameter of the second tenon portion 17*b* are substantially the same as each other. The first tenon portion 17*a* is rotatably supported by a train wheel bridge (not illustrated), and the second tenon portion 17*b* is rotatably supported by the above-described main plate 102 (refer to FIG. 1).

In the axle portion body 16, an escape pinion 18 is integrally, molded from a substantially center in the axial direction to the first tenon portion 17*a*. The escape pinion 18 is adapted to mesh with the gear of the above-described second wheel & pinion 106 (refer to FIG. 1), and the rotation force of the second wheel & pinion 106 is transmitted to the axle portion 13.

As illustrated in FIG. 3, the escape wheel portion 14 is a member formed of a metallic material or a material having crystal orientation such as single crystal silicon, for example, and is formed by means of electroforming, a lithographie galvanoformung abformung (LIGA) process in which an optical method such as photolithography is incorporated, deep reactive ion etching (DRIE) or metal injection molding (MIM).

The escape wheel portion 14 has a substantially annular-shaped hub portion 20 which is press-fitted to the axle portion 13. In an outer peripheral portion of the hub portion 20, multiple (ten in the present embodiment) spokes 21 which are formed in a substantially oval shape to be elongated along a radial direction are integrally formed to have equal intervals in a circumferential direction. Then, the adjacent spokes 21 are in a state where base side portions rather than substantially central portions in the radial direction are connected to each other.

The spoke 21 is configured to include first multiple spokes 21*a* radially extending from the hub portion 20 and a second spoke 21*b* extending in a forked shape from a distal end of the first spoke 21*a*. Then, distal ends of the second spoke 21*b* are connected to each other. The first spoke 21*a* and the second spoke 21*b* form multiple (ten) openings 22. The escape wheel portion 14 is decreased in weight by forming the openings 22.

In addition, a tooth portion 23 tapering in a rotating direction (clockwise direction in FIG. 3) of the escape wheel 11 is integrally molded in a connection portion 21*c* where the distal ends of the second spoke 21*b* are connected to each other.

The tooth portion 23 of the escape wheel 11 is configured so that a surface in the rotating direction side of the escape wheel 11 is a contact surface 23*a* which comes into contact with an entry pallet 45 (refer to FIG. 2, corresponding to a "first pallet" in claims) and an exit pallet 38 (refer to FIG. 2, corresponding to a "second pallet" in claims) of the pallet fork 12 (to be described later).

The contact surface 23*a* of the tooth portion 23 of the escape wheel 11 is tilted toward a rotation center Q side of the escape wheel 11.

As illustrated in FIG. 2, the double roller 53 is disposed in the balance 5 (to be described later) which pivotally moves around a balance staff 51, is a component of the balance 5, and is a component of the escapement 1. The double roller 53 is a member formed in a cylindrical shape, and is externally and fixedly fitted to the balance staff 51 so as to be arranged coaxially with a central axis O of the balance staff 51. Similar to the escape wheel portion 14, the double roller 53 is a member formed of a metallic material or a material having crystal orientation such as single crystal silicon, for example, and is formed by means of the electroforming, the LIGA process in which an optical method such as photolithography is incorporated, the DRIE or the MIM. A manufacturing method of the double roller 53 is not limited to the above-described methods. For example, the double roller 53 may be formed by performing mechanical processing on the metallic material.

The double roller 53 includes a cone back face rib 54 formed at a position corresponding to the escape wheel 11 in the axial direction of the balance staff, a retaining rib 55 formed on the further rear side (lower side in FIG. 2) of the movement 101 (refer to FIG. 1) than the cone back face rib 54, and a connection portion 56 connecting the cone back face rib 54 and the retaining rib 55. The cone back face rib 54, the retaining rib 55 and a connection portion 56 are integrally formed.

Figure 4:
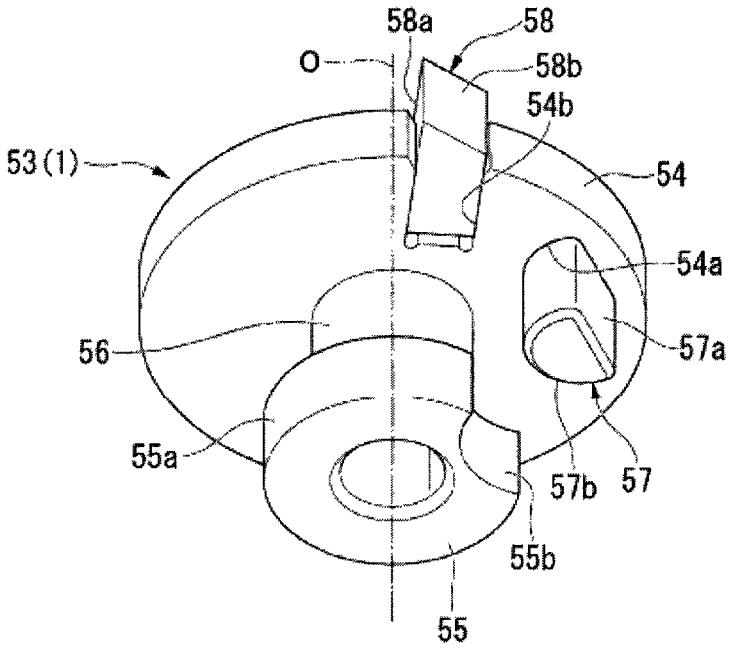
FIG. 4 is a perspective view of a double roller.
Figure 5:
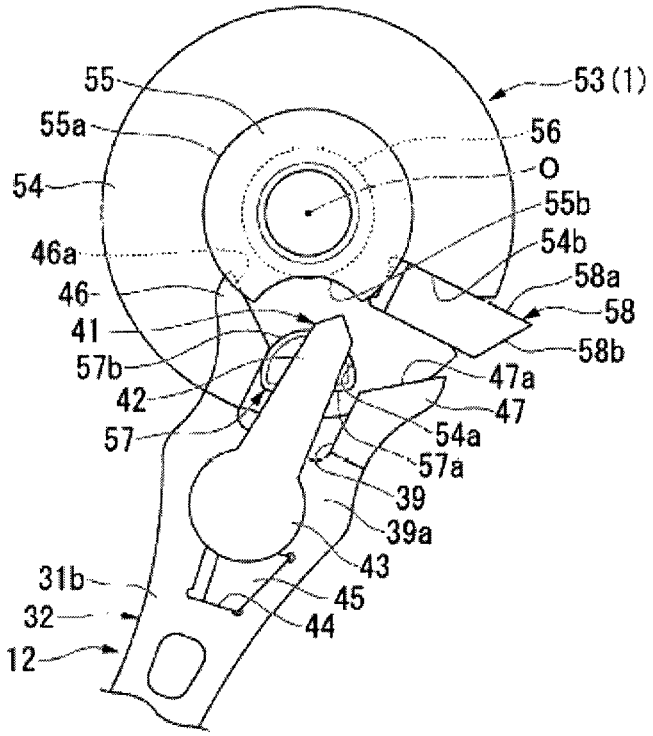
FIG. 5 is a plan view of the double roller and a pallet fork.

FIG. 4 is a perspective view of the double roller 53, and FIG. 5 is a plan view of the double roller 53 and the pallet fork 12. FIGS. 4 and 5 are views when viewed from the rear side of the movement 101 (refer to FIG. 1).

As illustrated in FIG. 4, the cone back face rib 54 is a disc-shaped member, and has a through-hole 54*a* penetrating in the axial direction and a slit 54*b* formed so as to extend along the radial direction.

The through-hole 54*a* is formed in a semicircular shape which has a plane radially outward and has an arc radially inward when viewed from the axial direction. For example, a first impulse pin 57 is fixedly press-fitted to the through-hole 54*a*.

As illustrated in FIG. 5, the first impulse pin 57 is formed of a ruby, for example, in a semicircular shape which has a flat surface 57*a* radially outward and has an arcuate surface 57*b* radially inward when viewed from the axial direction. The first impulse pin 57 is disposed along the axial direction and protrudes toward the rear side (lower side in FIG. 2) of the movement 101 (refer to FIG. 1) from the cone back face rib 54. In this manner, as described in FIG. 2, the first impulse pin 57 can come into contact with the pallet fork 12 (to be described later) at a position deviated from the balance staff 51 in the axial direction, which is the further rear side of the movement 101 (refer to FIG. 1) than a position where the entry pallet 45 and the exit pallet 38 come into contact with the tooth portion 23 of the escape wheel 11.

The slit 54*b* is formed in a U-shape which has an opening radially outward when viewed from the axial direction. A second impulse pin 58 is inserted into the slit 54*b* from the outside in the radial direction, and is fixed thereto by an adhesive, for example.

The second impulse pin 58 is formed of a ruby, for example, in a rectangular plate shape. The second impulse pin 58 is disposed along the radial direction and a distal end portion protrudes radially outward from an outer peripheral surface of the cone back face rib 54. A collision surface 58*a* which is flat along the radial direction is formed in the protruding portion of the second impulse pin 58. The tooth portion 23 (refer to FIG. 2) of the escape wheel 11 can collide with the collision surface 58*a*. In addition, a tilted surface 58*b* which is tilted radially inward is formed in the protruding portion of the second impulse pin 58.

The retaining rib 55 is a disc-shaped member, and has a diameter smaller than that of the cone back face rib 54. On an outer peripheral surface 55*a* of the retaining rib 55, a crescent-shaped portion 55*b* having a curved surface shape which is recessed radially inward is formed at a position corresponding to the first impulse pin 57. The crescent-shaped portion 55*b* has a function as a clearance portion which prevents the blade tip 41 of the pallet fork 12 from coming into contact with the retaining rib 55 when the pallet fork 12 (to be described later) and the first impulse pin 57 engage with each other. In addition, the blade tip 41 of the pallet fork 12 can come into sliding contact with a partial region on both circumferential sides across the crescent-shaped portion 55*b* within the outer peripheral surface 55*a* of the retaining rib 55.

As illustrated in FIG. 2, the pallet fork 12 includes a pallet fork body 32 which is formed in a substantially L-shape in a plan view by two pallet beams 31*a* and 31*b*, a pallet staff 33 which pivotally supports the pallet fork body 32, and two pallets (entry pallet 45 and exit pallet 38).

The pallet staff 33 has an axle portion 34. Then, in the axle portion 34, a first tenon portion 35*a* is integrally formed in an end portion of the front side (upper side in FIG. 2) of the movement 101 (refer to FIG. 1). A second tenon portion 35*b* is integrally formed in an end portion of the rear side (lower side in FIG. 2) of the movement 101 (refer to FIG. 1). An axle diameter of the first tenon portion 35*a* and an axle diameter of the second tenon portion 35*b* are substantially the same as each other. The first tenon portion 35*a* is rotatably supported by a pallet bridge (not illustrated), and the second tenon portion 35*b* is rotatably supported by the above-described main plate 102 (refer to FIG. 1).

A flange portion 36 is disposed in a substantially center in the axial direction of the axle portion 34. The pallet fork body 32 is placed on the flange portion 36.

Figure 6:
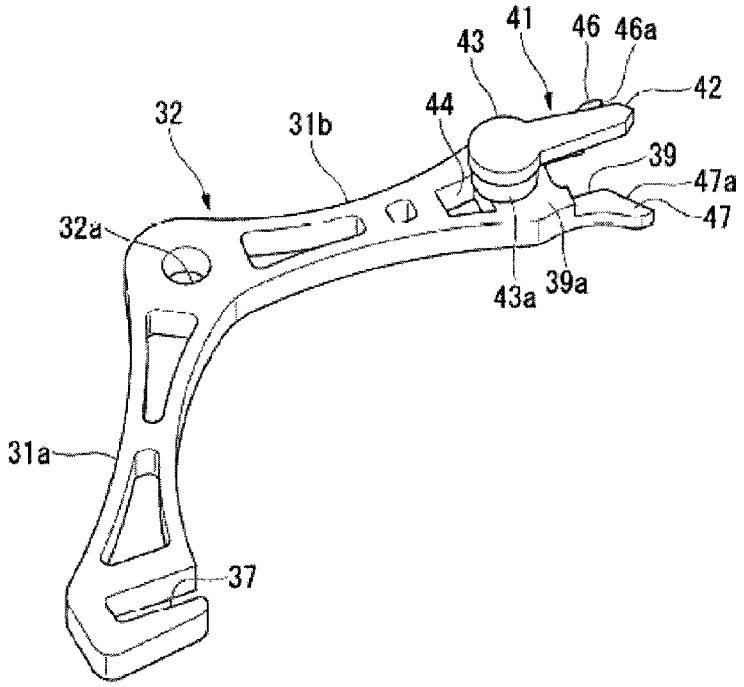
FIG. 6 is a perspective view of a pallet fork body.

FIG. 6 is a perspective view of the pallet fork body 32.

As illustrated in FIG. 6, a through-hole 32*a* into which the axle portion 34 (refer to FIG. 2) of the pallet staff 33 can be inserted is formed in a connection portion between the two pallet beams 31*a* and 31*b* in the pallet fork body 32. By inserting the axle portion 34 into the through-hole 32*a*, the pallet fork body 32 is placed on the flange portion 36 (refer to FIG. 2) of the axle portion 34.

As illustrated in FIG. 2, a slit 37 is formed in a distal end of one pallet beam 31*a* out of the two pallet beams 31*a* and 31*b* so that the escape wheel 11 side is open. The exit pallet 38 is fixed to the slit 37 by an adhesive, for example.

The exit pallet 38 is formed of a ruby, for example, in a rectangular plate shape, protrudes inward in the radial direction of the escape wheel 11 from the distal end of the pallet beam 31*a*, and protrudes toward the escape wheel 11 so as to extend along the axial direction of the escape wheel 11. The exit pallet 38 can disengage from the tooth portion 23 of the escape wheel 11 by the pivotal movement of the pallet fork 12.

A sliding surface 38*a* which intersects the circumferential direction of the escape wheel 11 and on which the tooth portion 23 of the escape wheel 11 is slidable during the rotation of the escape wheel 11 is formed in a distal end of the exit pallet 38. The tooth portion 23 of the escape wheel 11 is adapted to slide on the sliding surface 38*a* by being disengaged from the exit pallet 38 and the escape wheel 11 being rotated. In this manner, the exit pallet 38 moves outward in the radial direction of the escape wheel 11, and the pallet fork 12 pivotally moves around the pallet staff 33, by setting a central axis P of the pallet staff 33 to be a rotation center.

In addition, a further proximal end side than the sliding surface 38*a* of the exit pallet 38 is an engagement surface 38*b* which engages with the tooth portion 23 of the escape wheel 11.

Figure 7:
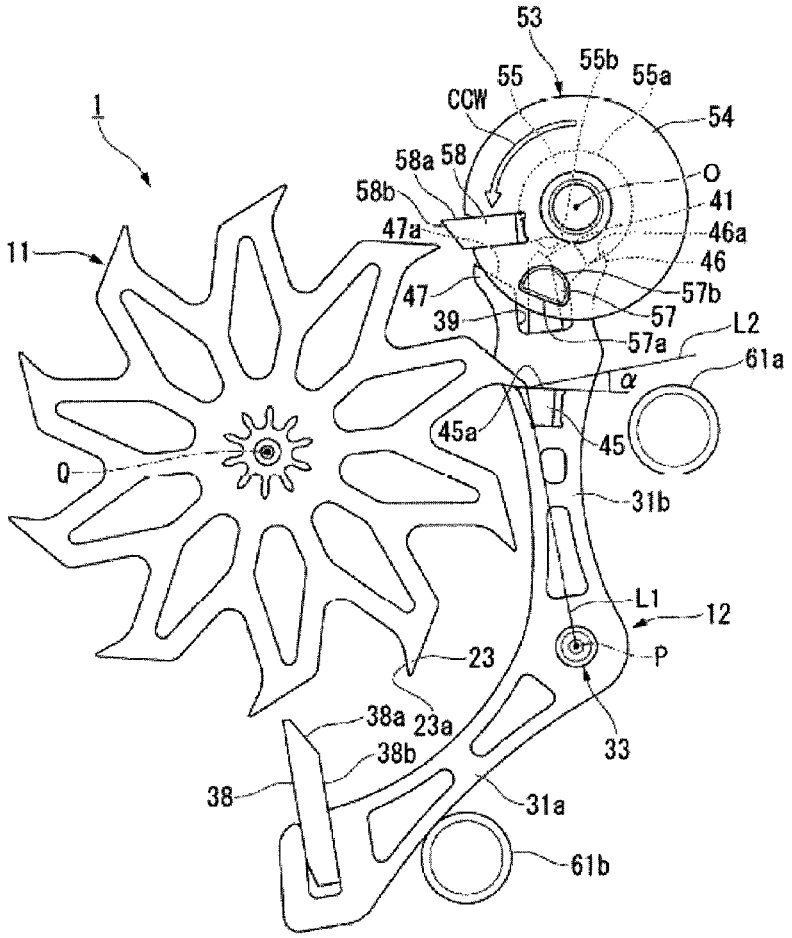
FIG. 7 is a diagram illustrating an operation of the escapement.

FIG. 7 is a diagram illustrating an operation of the escapement 1, and illustrates a state where an engagement surface 45*a* of the entry pallet 45 engages with the contact surface 23*a* of the tooth portion 23 of the escape wheel 11.

Here, when viewed from the axial direction of the rotation center Q of the escape wheel 11, a straight line connecting the central axis P of the pallet staff 33 and a tooth tip of the tooth portion 23 of the escape wheel 11 is set to be a first straight line L1 and a straight line orthogonal to the first straight lie L1 is set to be a second straight line L2. When the contact surface 23*a* of the escape wheel 11 engages with the engagement surface 45*a* of the entry pallet 45, the engagement surface 45*a* of the entry pallet 45 is tilted with respect to the second straight line L2 at a predetermined angle $\alpha$ in the rotating direction of the escape wheel. The predetermined angle $\alpha$ is set to be approximately 11° to 16°.

As described above, the engagement surface 45*a* of the entry pallet 45 is tilted with respect to the second straight line L2 at the predetermined angle $\alpha$ in the rotating direction of the escape wheel 11. Therefore, if the tooth portion 23 of the escape wheel 11 and the entry pallet 45 engage with each other, a torque acts on the entry pallet 45 so that the rotation torque of the escape wheel 11 draws the entry pallet 45 into the escape wheel 11 side. In this manner, it is possible to stabilize an engagement state between the tooth portion 23 of the escape wheel 11 and the entry pallet 45. Therefore, for example, it is possible to prevent the engagement position of the entry pallet 45 with the tooth portion 23 of the escape wheel 11 from being deviated therefrom due to the disturbance. Accordingly, it is possible to prevent an abnormal operation where the pallet fork 12 is caused to pivotally move due to the disturbance, the retaining rib 55 and the blade tip 41 come into contact with each other to interfere with the balance 5 (refer to FIG. 2), and consequently free vibration of the balance 5 is hindered.

As illustrated in FIG. 6, stag beetle-shaped portions 46 and 47 are disposed side by side in a width direction of the pallet beam 31*b*, on a distal end side of the other pallet beam 31*b* out of the two pallet beams 31*a* and 31*b*. Tilted surfaces 46*a* and 47*a* which are gradually tilted to the proximal end side of the stag beetle-shaped portions 46 and 47 are respectively formed inward from the outer side in the width direction of the pallet beam 31*b*, in the distal end portions of the stag beetle-shaped portions 46 and 47.

As illustrated in FIG. 5, a pallet receptacle 39 from which the first impulse pin 57 can disengage by the pivotal movement of the double roller 53 is formed inside the stag beetle-shaped portions 46 and 47.

For example, a convex portion (no illustrated) is integrally formed in a base portion 39*a* of the pallet receptacle 39, and the blade tip 41 configuring the pallet receptacle 39 is attached to the convex portion.

The blade tip 41 is configured to have a blade tip body 42 and a disc-shaped attachment portion 43 which is integrally formed in the proximal end of the blade tip body 42. A substantially cylindrical fitting portion 43*a* (refer to FIG. 6) which can be fitted to the convex portion of the base portion 39*a* is integrally formed in the attachment portion 43, for example. The blade tip 41 is fixedly press-fitted in a state where the fitting portion 43*a* is fitted to the convex portion. The blade tip 41 may fixedly adhere to the base portion 39*a* of the pallet receptacle 39 by an adhesive, for example.

During the rotation of the double roller 53, the distal end of the blade tip 41 comes into sliding contact with a partial region on both circumferential sides across the crescent-shaped portion 55*b* within the outer peripheral surface 55*a* of the retaining rib 55. This can prevent the pallet fork from pivotally moving even in a state where the first impulse pin 57 is detached from the pallet receptacle.

As illustrated in FIG. 2, in the pallet beam 31*b* having the pallet receptacle 39, a pallet attachment hole 44 is formed in the proximal end side of the pallet receptacle 39. The entry pallet 45 fixedly adheres to the pallet attachment hole 44 by an adhesive, for example. The entry pallet 45 is formed of a ruby for example, in a square pillar shape, and protrudes toward the escape wheel 11 side so as to extend along the central axis P of the pallet staff 33 from the distal end of the pallet beam 31*b*. A side surface facing the opposite side to the pallet staff 33 of the entry pallet 45 is the engagement surface 45*a* which engages with the tooth portion 23 of the escape wheel 11. The entry pallet 45 can disengage from the tooth portion 23 of the escape wheel 11 by the pivotal movement of the pallet fork 12.

A pair of banking pins 61*a* and 61*b* is disposed on the opposite side of the escape wheel 11 across the pallet fork 12. The banking pins 61*a* and 61*b* are erected from the main plate 102 (refer to FIG. 1), and are respectively disposed at a position higher than a position of the pallet fork 12. The pivotal movement of the pallet fork 12 causes the pallet beams 31*a* and 31*b* to come into contact with the banking pins 61*a* and 61*b*. This regulates an amount of the pivotal movement of the pallet forks 12.

(Speed Regulator and Balance)

The balance 5 of the speed regulator 2 has the balance staff 51 serving as a pivot, the balance wheel 52 which is externally and fixedly fitted to the balance staff 51, the above-described double roller 53 and a hairspring (not illustrated). Both ends of the balance staff 51 are rotatably supported by a balance bridge (not illustrated) and the main plate 102. The escape wheel 11 is rotated and collides with the second impulse pin 58, thereby providing energy generated from the escape wheel 11 to the balance 5 as a rotation force. In addition, the tooth portion 23 of the escape wheel 11 slides on the sliding surface 38*a* and the pallet fork 12 pivotally moves to collide with the first impulse pin 57, thereby providing the energy generated from the escape wheel 11 to the balance 5 as the rotation force. Furthermore, the energy of the escape wheel 11 is accumulated in the hairspring of the balance 5 as a spring force. Accordingly, the rotation force generated by the energy provided from the escape wheel 11 and the spring force of the hairspring enable the balance 5 to pivotally move while performing free vibration at a predetermined cycle around the central axis O of the balance staff 51.

(Action)

Figure 9:
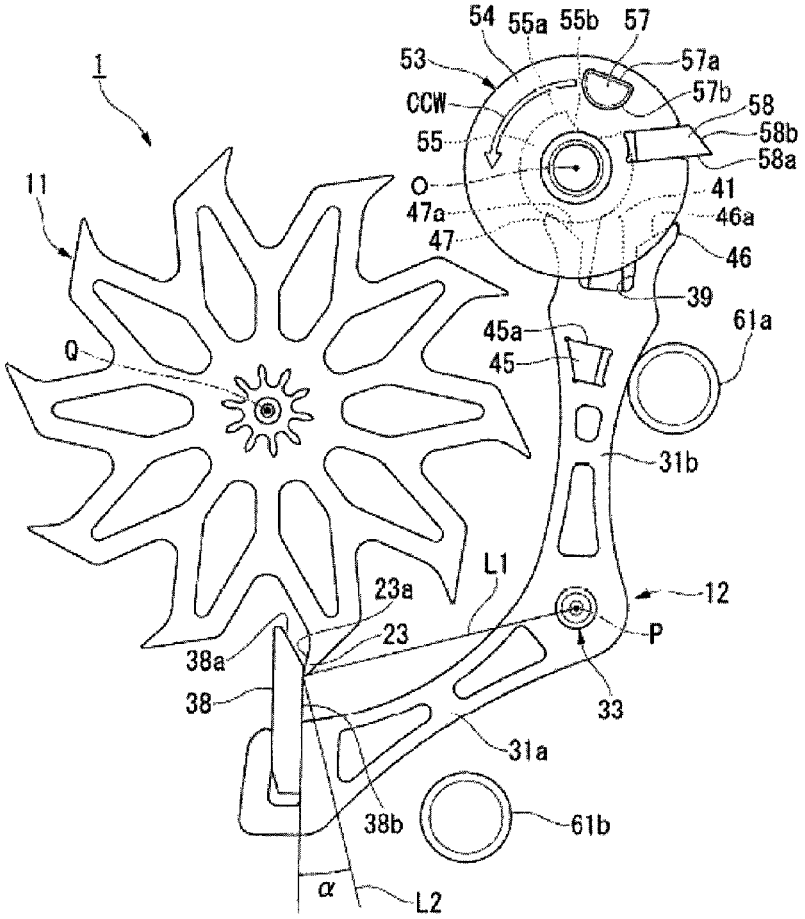
FIG. 9 is a diagram illustrating an operation of the escapement.
Figure 10:
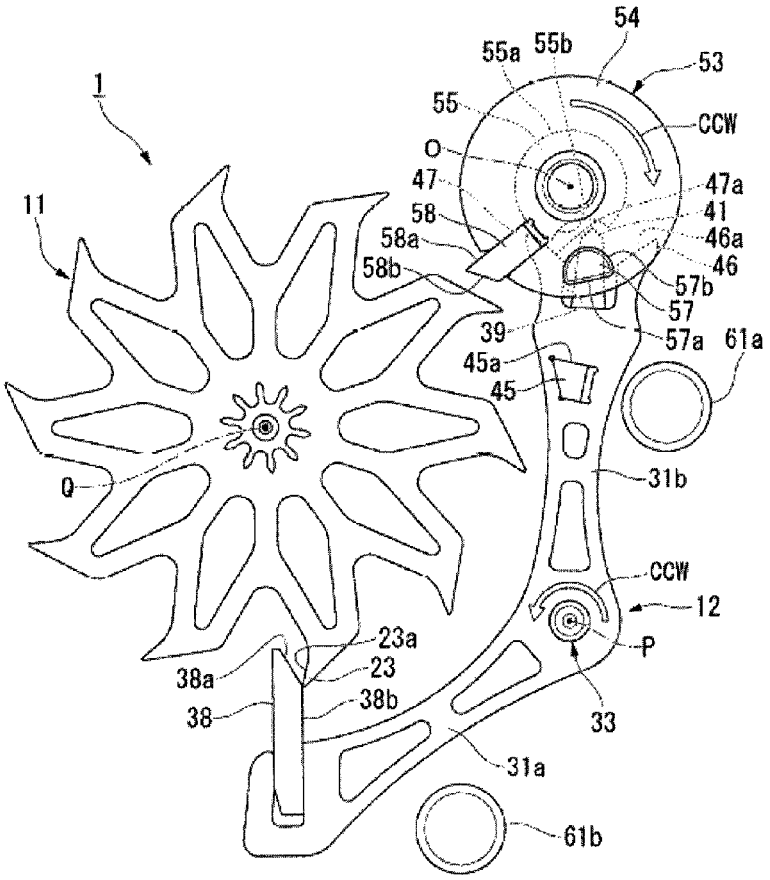
FIG. 10 is a diagram illustrating an operation of the escapement.
Figure 11:
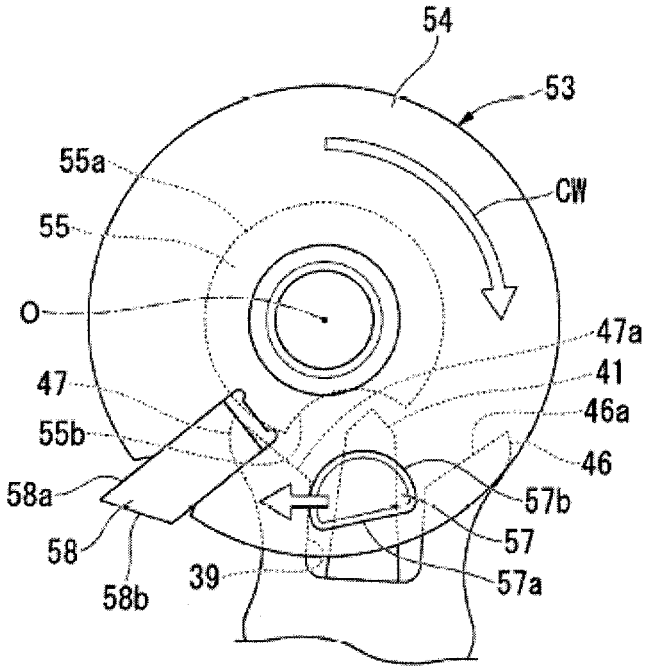
FIG. 11 is a diagram illustrating an operation of the escapement, and is an enlarged view of the double roller and a pallet receptacle.

Subsequently, an action of the escapement 1 configured as described above will be described with reference to diagrams illustrating each operation in FIGS. 7 to 14. FIGS. 11 and 13 are enlarged views of the double roller 53 and the pallet receptacle 39.

Hereinafter, a case will be sequentially described in which the double roller 53 pivotally moves around the central axis O in the counterclockwise direction (hereinafter, the "counterclockwise direction" is referred to as a "CCW direction") in response to the free vibration of the balance 5, and then the double roller 53 pivotally moves around the central axis O in the clockwise direction (hereinafter, the "clockwise direction" is referred to as a "CW direction"). In addition, in an operation start state in the description, as illustrated in FIG. 7, the exit pallet 38 is detached from the tooth portion 23 of the escape wheel 11, and the engagement surface 45*a* of the entry pallet 45 engages with the tooth portion 23 of the escape wheel 11. In addition, one side pallet beam 31*a* holding the exit pallet 38 is in contact with the banking pin 61*b*, and the other side pallet beam 31*b* holding the entry pallet 45 is detached from the banking pin 61*a*.

As illustrated in FIG. 7, if the double roller 53 pivotally moves in the CCW direction, the pallet receptacle 39 of the pallet fork 12 engages with the first impulse pin 57. At this time, the arcuate surface 57*b* of the first impulse pin 57 comes into contact with the inner surface of one side (right side in FIG. 7) stag beetle-shaped portion 46. In this manner, the rotation force of the double roller 53 (that is, the spring force of the hairspring of the balance 5, refer to FIG. 2) acts on the pallet fork 12.

Figure 8:
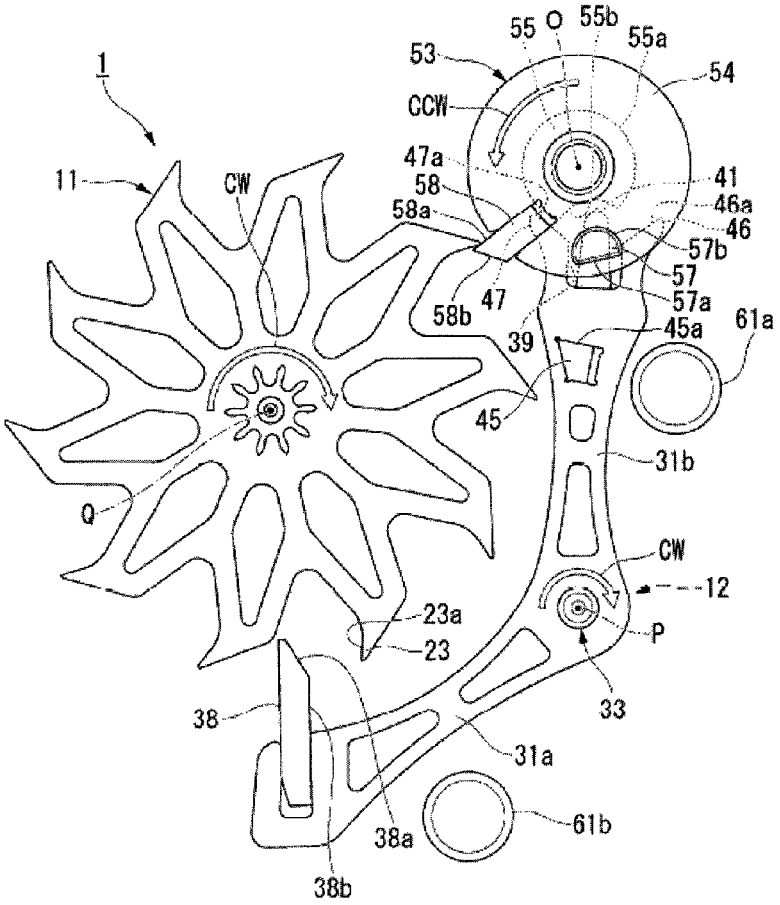
FIG. 8 is a diagram illustrating an operation of the escapement.

Subsequently, as illustrated in FIG. 8, if the double roller 53 further pivotally moves in the CCW direction, the arcuate surface 57*b* of the first impulse pin 57 presses one side stag beetle-shaped portion 46. This causes the pallet fork 12, the entry pallet 45 and the exit pallet 38 which are held in the pallet fork 12 to pivotally move around the central axis P of the pallet staff 33 in the CW direction. Here, the crescent-shaped portion 55*b* is formed in the retaining rib 55. In this manner, during the engagement between the pallet fork 12 and the first impulse pin 57, the retaining rib 55 and the blade tip 41 of the pallet fork 12 do not contact with each other. Therefore, without interfering with the pivotal movement of the pallet fork 12, it is possible to efficiently transmit the rotation force of the double roller 53 to the pallet fork 12.

If the pallet fork 12 pivotally moves, the entry pallet 45 moves in a direction away from the escape wheel 11. This causes the entry pallet 45 to disengage from the tooth portion 23 of the escape wheel 11. The entry pallet 45 is detached from the tooth portion 23 of the escape wheel 11 and the escape wheel 11 is rotated in the CW direction.

In addition, if the escape wheel 11 is rotated in the CW direction, the tooth portion 23 of the escape wheel 11 collides with the collision surface 58*a* of the second impulse pin 58. In this manner, the energy generated from the escape wheel 11 is provided for the double roller 53 (that is, the balance 5, refer to FIG. 2) as the rotation force, and the double roller 53 further pivotally moves in the CCW direction.

In addition, if the pallet fork 12 pivotally moves, the exit pallet 38 moves in a direction moving close to the escape wheel 11. Then, as illustrated in FIG. 9, the exit pallet 38 moving close to the escape wheel 11 comes into contact with the rotating escape wheel 11, and the engagement surface 38*b* of the exit pallet 38 engages with the tooth portion 23 of the escape wheel 11.

Here, when similar to the above-described relationship between the contact surface 23*a* of the escape wheel 11 and the engagement surface 45*a* of the entry pallet 45, the contact surface 23*a* of the escape wheel 11 and the engagement surface 38*b* of the exit pallet 38 engage with each other, the engagement surface 38*b* of the exit pallet 38 is tilted with respect to the second straight line L2 at a predetermined angle α in the rotating direction of the escape wheel. In this manner, if the tooth portion 23 of the escape wheel 11 engages with the exit pallet 38, a torque acts on the exit pallet 38 so that the rotation torque of the escape wheel 11 draws the exit pallet 38 into the escape wheel 11 side. In this manner, it is possible to stabilize an engagement state between the tooth portion 23 of the escape wheel 11 and the exit pallet 38. Therefore, for example, it is possible to prevent the engagement position of the exit pallet 38 with the tooth portion 23 of the escape wheel 11 from being deviated therefrom due to the disturbance. Accordingly, it is possible to prevent an abnormal operation where the pallet fork 12 is caused to pivotally move due to the disturbance, for example, the retaining rib 55 and the blade tip 41 come into contact with each other to interfere with the balance 5 (refer to FIG. 2), and consequently the free vibration of the balance 5 is hindered.

In addition, at this time, the pivotal movement of the double roller 53 in the CCW direction causes the first impulse pin 57 and the pallet receptacle 39 of the pallet fork 12 to disengage from each other. Here, the blade tip 41 of the pallet fork 12 is configured so that a surface of the escape wheel 11 side is in contact with the outer peripheral surface 55*a* of the retaining rib 55. This can prevent the pallet fork 12 from pivotally moving so as to be away from the banking pin 61*a*, even in a state where the first impulse pin 57 is detached from the pallet receptacle 39. Accordingly, it is possible to prevent an abnormal operation, so-called shaking, in which when the double roller 53 pivotally moves in the CCW direction, the first impulse pin 57 is detached from the pallet receptacle 39, then the double roller 53 pivotally moves in the CW direction, and the first impulse pin 57 engages with the pallet receptacle 39 again, the first impulse pin 57 comes into contact with the outer side surface (in this case, the outer surface of one side stag beetle-shaped portion 46) of the pallet receptacle 39, the movement of the first impulse pin 57 is hindered by the pallet fork 12, and the pivotal movement of the balance 5 (refer to FIG. 2) is stopped.

In addition, as illustrated in FIG. 2, the escapement 1 of the present embodiment ensures a meshing amount of the entry pallet 45 and the exit pallet 38 with the tooth portion 23 of the escape wheel 11 so as to obtain a predetermined required amount or more. In this manner, it is possible to prevent the following abnormal operation, so-called a semi-shaking phenomenon. In an operating state where the entry pallet 45 and the exit pallet 38 are not supposed to disengage from the tooth portion 23 of the escape wheel 11 in the originally planned operation of the escapement 1, for example, in a state where the first impulse pin 57 is not supposed to enter the pallet receptacle 39, strong disturbance causes the entry pallet 45 and the exit pallet 38 to disengage from the tooth portion 23 of the escape wheel 11, and the escape wheel 11 falls on the sliding surface 38*a* of the exit pallet 38, for example. The impact is transmitted from the escape wheel 11 to the pallet fork 12 and the pallet fork 12 is caused to pivotally move. Consequently, the stag beetle-shaped portions 46 and 47 press the first impulse pin 57. In addition, the blade tip 41 (refer to FIG. 5) presses the retaining rib 55. Consequently, the balance 5 is pressed by the pallet fork 12 in the radial direction of the balance 5, and the pivotal movement of the balance 5 is eventually stopped.

The double roller 53 is configured so that the pivotal movement direction is reversed to the CW direction after the pivotal movement amount in the CCW direction is maximized. Then, as illustrated in FIG. 10, the pallet receptacle 39 of the pallet fork 12 engages with the first impulse pin 57 again. At this time, as illustrated in FIG. 11, the arcuate surface 57*b* of the first impulse pin 57 comes into contact with the inner surface of the other side (left side in FIG. 11) stag beetle-shaped portion 47. This causes the rotation force of the double roller 53 (that is, the spring force of the hairspring of the balance 5, refer to FIG. 2) to act on the pallet fork 12. Then, if the double roller 53 further pivotally moves in the CW direction, as illustrated in FIG. 10, the pallet fork 12, and the entry pallet 45 and the exit pallet 38 which are held in the pallet fork 12 pivotally move around the central axis P of the pallet staff 33 in the CCW direction.

Figure 12:
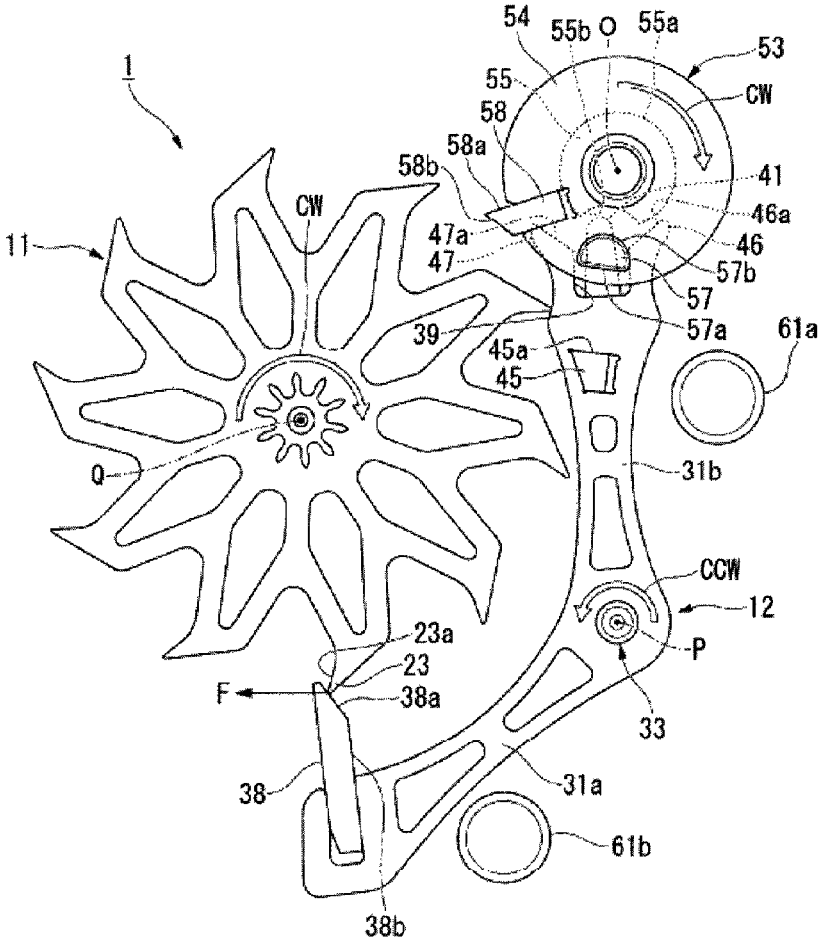
FIG. 12 is a diagram illustrating an operation of the escapement.
Figure 13:
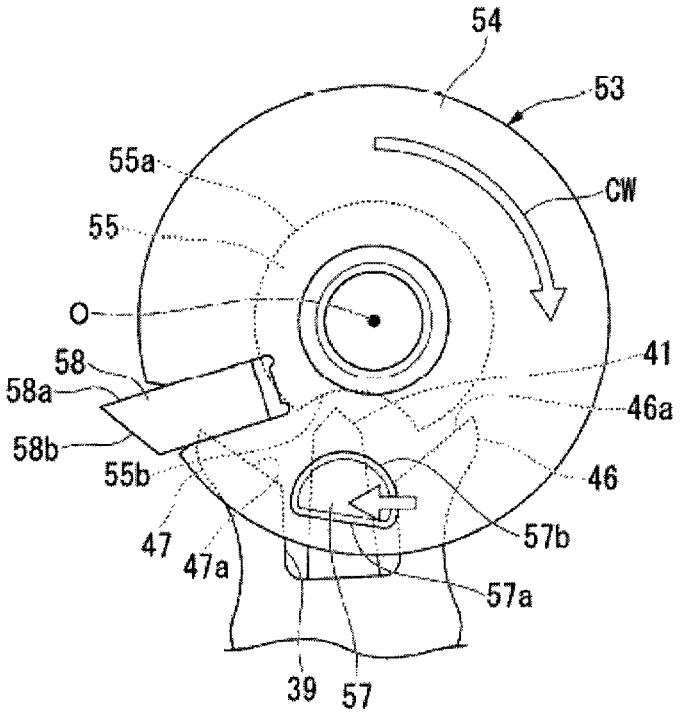
FIG. 13 is a diagram illustrating an operation of the escapement, and is an enlarged view of the double roller and the pallet receptacle.

Subsequently, as illustrated in FIG. 12, if the pallet fork 12 pivotally moves, the exit pallet 38 moves in the direction away from the escape wheel 11. This causes the engagement surface 38*b* of the exit pallet 38 to disengage from the tooth portion 23 of the escape wheel 11. The escape wheel 11 pivotally moves in the CW direction and the tooth portion 23 of the escape wheel 11 slides on the sliding surface 38*a*.

Here, a vertical component of the sliding surface 38*a* in a vector F of the rotation force of the escape wheel 11 causes the pallet fork 12 to pivotally move around the central axis P of the pallet staff 33 in the CCW direction.

At this time, as illustrated in FIG. 13, the pivotal movement of the pallet fork 12 causes the inner surface of one side (right side in FIG. 13) stag beetle-shaped portion 46 to collide with the arcuate surface 57*b* of the first impulse pin 57, thereby applying the impact to the first impulse pin 57. In other words, the tooth portion 23 of the escape wheel 11 slides on the sliding surface 38*a*. In this manner, a state where the torque is transmitted from the first impulse pin 57 to the pallet fork 12 as illustrated in FIG. 11 is switched over to a state where the torque is transmitted from the pallet fork 12 to the first impulse pin 57 as illustrated in FIG. 13. As described above, the energy of the rotation force provided from the escape wheel 11 is transmitted to the first impulse pin 57 (that is, the balance 5, refer to FIG. 2) of the double roller 53 via the pallet fork 12.

If the pallet fork 12 pivotally moves in the CCW direction, the exit pallet 38 moves in the direction away from the escape wheel 11. This causes the exit pallet 38 to be detached from the tooth portion 23 of the escape wheel 11, and the escape wheel 11 is further rotated in the CW direction.

Figure 14:
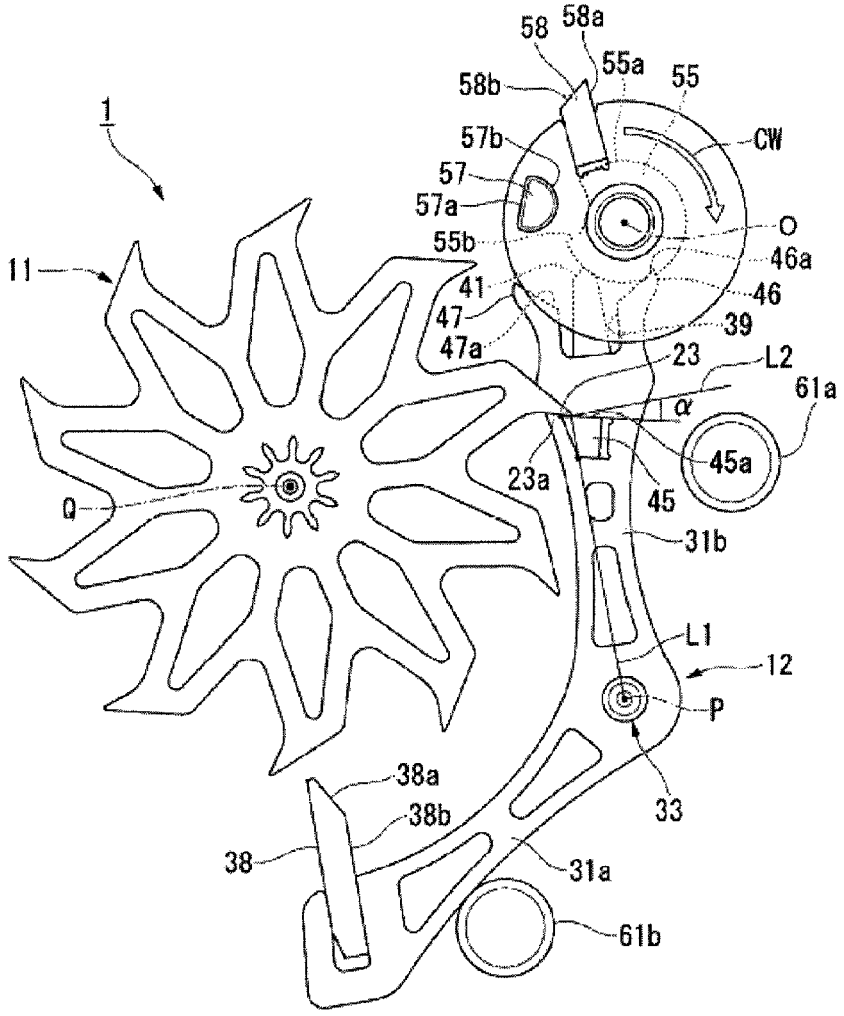
FIG. 14 is a diagram illustrating an operation of the escapement.

In addition, if the pallet fork 12 pivotally moves in the CCW direction, the entry pallet 45 moves in the direction moving close to the escape wheel 11. Then, as illustrated in FIG. 14, the entry pallet 45 moving close to the escape wheel 11 comes into contact with the rotating escape wheel 11, and the engagement surface 45*a* of the entry pallet 45 engages with the tooth portion 23 of the escape wheel 11.

Here, as described above, the engagement surface 45*a* of the entry pallet 45 is tilted with respect to the second straight line L2 at the predetermined angle α in the rotating direction of the escape wheel 11. Therefore, a torque acts on the entry pallet 45 so that the rotation torque of the escape wheel 11 draws the entry pallet 45 into the escape wheel 11 side. In this manner, it is possible to stabilize an engagement state between the tooth portion 23 of the escape wheel 11 and the entry pallet 45. Therefore, for example, it is possible to prevent the engagement position of the entry pallet 45 with the tooth portion 23 of the escape wheel 11 from being deviated therefrom due to the disturbance. Accordingly, it is possible to prevent an abnormal operation where the pallet fork 12 is caused to pivotally move due to the disturbance, for example, the retaining rib 55 and the blade tip 41 come into contact with each other to interfere with the balance 5 (refer to FIG. 2), and consequently the free vibration of the balance 5 is hindered.

In addition, at this time, the pivotal movement of the double roller 53 in the CW direction causes the first impulse pin 57 and the pallet receptacle 39 of the pallet fork 12 to disengage from each other. Here, the blade tip 41 of the pallet fork 12 is configured so that an opposite side surface to the escape wheel 11 is in contact with the outer peripheral surface 55*a* of the retaining rib 55. This can prevent the pallet fork 12 from pivotally moving so as to be away from the banking pin 61*b*, even in a state where the first impulse pin 57 is detached from the pallet receptacle 39. Accordingly, it is possible to prevent an abnormal operation, so-called shaking, in which when the double roller 53 pivotally moves in the CW direction, the first impulse pin 57 is detached from the pallet receptacle 39, then the double roller 53 pivotally moves in the CCW direction, and the first impulse pin 57 engages with the pallet receptacle 39 again, the first impulse pin 57 comes into contact with the outer side surface (in this case, the outer surface of the other side stag beetle-shaped portion 47) of the pallet receptacle 39, the movement of the first impulse pin 57 is hindered by the pallet fork 12, and the pivotal movement of the balance 5 (refer to FIG. 2) is stopped.

In addition, the escapement 1 of the present embodiment ensures a meshing amount of the entry pallet 45 and the exit pallet 38 with the tooth portion 23 of the escape wheel 11 so as to obtain a predetermined required amount or more. In this manner, it is possible to prevent the following abnormal operation, so-called a semi-shaking phenomenon. In an operating state where the entry pallet 45 and the exit pallet 38 are not supposed to disengage from the tooth portion 23 of the escape wheel 11 in the originally planned operation of the escapement 1, for example, in a state where the first impulse pin 57 is not supposed to enter the pallet receptacle 39, strong disturbance causes the entry pallet 45 and the exit pallet 38 to disengage from the tooth portion 23 of the escape wheel 11, and the escape wheel 11 falls on the sliding surface 38*a* of the exit pallet 38, for example. The impact is transmitted from the escape wheel 11 to the pallet fork 12 and the pallet fork 12 is caused to pivotally move. Consequently, the stag beetle-shaped portions 46 and 47 press the first impulse pin 57. In addition, the blade tip 41 (refer to FIG. 5) presses the retaining rib 55. Consequently, the balance 5 is pressed by the pallet fork 12 in the radial direction of the balance 5, and the pivotal movement of the balance 5 is eventually stopped.

The double roller 53 is configured so that the pivotal movement direction is reversed to the CCW direction after the pivotal movement amount in the CW direction is maximized (refer to FIG. 7). Thereafter, the above-described operation is repeated. In this manner, the tooth portion 23 of the escape wheel 11 repeatedly and alternately disengages from the entry pallet 45 and the exit pallet 38. This enables the escape wheel 11 to be rotated in the CW direction at a constant speed at all times.

According to the first embodiment, the pallet fork 12 includes two pallets of the entry pallet 45 and the exit pallet 38. Therefore, as compared to the related art including three pallets, one pallet can be reduced and a space for fixing the reduced pallet can be reduced. In addition, as compared to the related art, the pallet and the escape pinion 18 do not need to come into contact with each other. Therefore, it is possible to decrease the escape pinion 18 in diameter. This enables the pallet fork 12 and the escape wheel 11 to be decreased in size and in weight. Accordingly, it is possible to decrease viscosity frictional resistance and solid frictional resistance when the pallet fork 12 and the escape wheel 11 pivotally move. In addition, the decreased weight of the pallet fork 12 and the escape wheel 11 decreases the moment of inertia compared to the related art. Therefore, the pallet fork 12 can pivotally and quickly move. In this manner, an impact range is widened when the pallet fork 12 collides with the first impulse pin 57 and the escape wheel 11 collides with the second impulse pin 58. Accordingly, it is possible to efficiently transmit the energy. As described above, it is possible to improve the energy transmission efficiency from the escape wheel 11 to the balance 5 by virtue of the decreased size and the decreased weight of the pallet fork 12 and the escape wheel 11.

In addition, the double roller 53 includes the first impulse pin 57 which comes into contact with the pallet fork 12 in response to the pivotal movement of the double roller 53 and causes the pallet fork 12 to pivotally move around the pallet staff 33, and the second impulse pin 58 which can come into contact with tooth portion 23 of the escape wheel 11. Therefore, for example, even in the escapement requiring lubrication in the pallets and the tooth portion of the escape wheel, it is possible to suppress the oil spreading to the contact portion between the first impulse pin 57 and the pallet fork 12. Accordingly, it is possible to ensure a stable operation of the speed regulator 2 including the escapement 1 and the balance 5 by preventing oil adhesion or an increase in viscosity resistance caused by deterioration of adhering oil. Therefore, it is possible to prevent timing accuracy from being deteriorated.

Furthermore, without depending on a position of the first impulse pin 57, it is possible to set a desired position of the second impulse pin 58, a desired outer diameter of the escape wheel 11, and a desired separating distance between the balance staff 51 and the rotation center Q of the escape wheel 11. In this manner, it is possible to set a desired impact range when the tooth portion 23 of the escape wheel 11 and the second impulse pin 58 collide with each other. Therefore, it is possible to set a desired balance between the energy transmission efficiency of the escapement 1 and the timing accuracy.

In addition, when the double roller 53 pivotally moves in the CCW direction, the entry pallet 45 and the escape wheel 11 are disengaged from each other, and the tooth portion 23 of the escape wheel 11 and the second impulse pin 58 come into contact with each other. Accordingly, it is possible to provide the energy by directly applying the impact to the second impulse pin 58 from the escape wheel 11. In addition, when the double roller 53 pivotally moves in the CW direction, the exit pallet 38 and the escape wheel 11 are disengaged from each other, and the tooth portion 23 of the escape wheel 11 is caused to slide on the sliding surface 38*a*. Therefore, it is possible to cause the pallet fork 12 to pivotally move around the pallet staff 33 by moving the exit pallet 38. Accordingly, it is possible to provide the energy by applying the impact to the first impulse pin 57 from the escape wheel 11 via the pallet fork 12.

In addition, the present embodiment is provided with the retaining rib 55 with which the blade tip 41 comes into sliding contact. Therefore, it is possible to prevent the pallet fork 12 from pivotally moving, even in a state where the first impulse pin 57 is detached from the pallet receptacle 39. Accordingly, it is possible to prevent an abnormal operation, so-called shaking, in which the first impulse pin 57 is detached from the pallet receptacle 39, then the first impulse pin 57 comes into contact with the outer side surface of the pallet receptacle 39, the movement of the first impulse pin 57 is hindered by the pallet fork 12, and the pivotal movement of the balance 5 is stopped.

In addition, the engagement surface 45*a* of the entry pallet 45 and the engagement surface 38*b* of the exit pallet 38 are tilted with respect to the second straight line L2 at the predetermined angle α in the rotating direction of the escape wheel 11. Therefore, if the tooth portion 23 of the escape wheel 11 engages with the entry pallet 45 and the exit pallet 38, a torque acts on the respective entry pallet 45 and exit pallet 38 so that the rotation torque of the escape wheel 11 draws the respective pallets into the escape wheel 11 side. In this manner, it is possible to stabilize an engagement state between the tooth portion 23 of the escape wheel 11 and the entry pallet 45, and the exit pallet 38. Therefore, for example, it is possible to prevent the engagement position of the entry pallet 45 and the exit pallet 38 with the tooth portion 23 of the escape wheel 11 from being deviated therefrom due to the disturbance. Accordingly, it is possible to prevent an abnormal operation where the pallet fork 12 is caused to pivotally move due to the disturbance, the retaining rib 55 and the blade tip 41 come into contact with each other to interfere with the balance 5, and consequently the free vibration of the balance 5 is hindered.

In addition, the present embodiment is provided with the above-described escapement 1. Accordingly, it is possible to provide the high-performance timepiece movement 101 and the high-performance timepiece 100 which can improve the energy transmission efficiency and are excellent in the timing accuracy.

Second Embodiment

Figure 15:
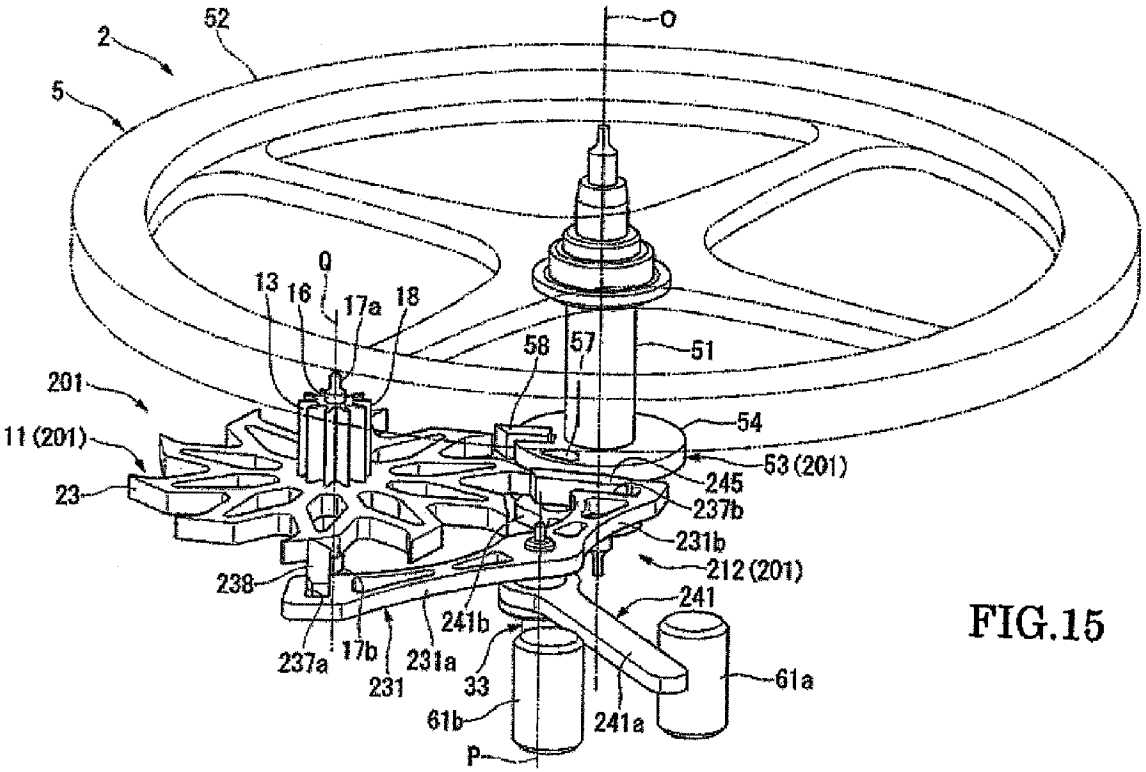
FIG. 15 is a perspective view of an escapement according to a second embodiment.
Figure 16:
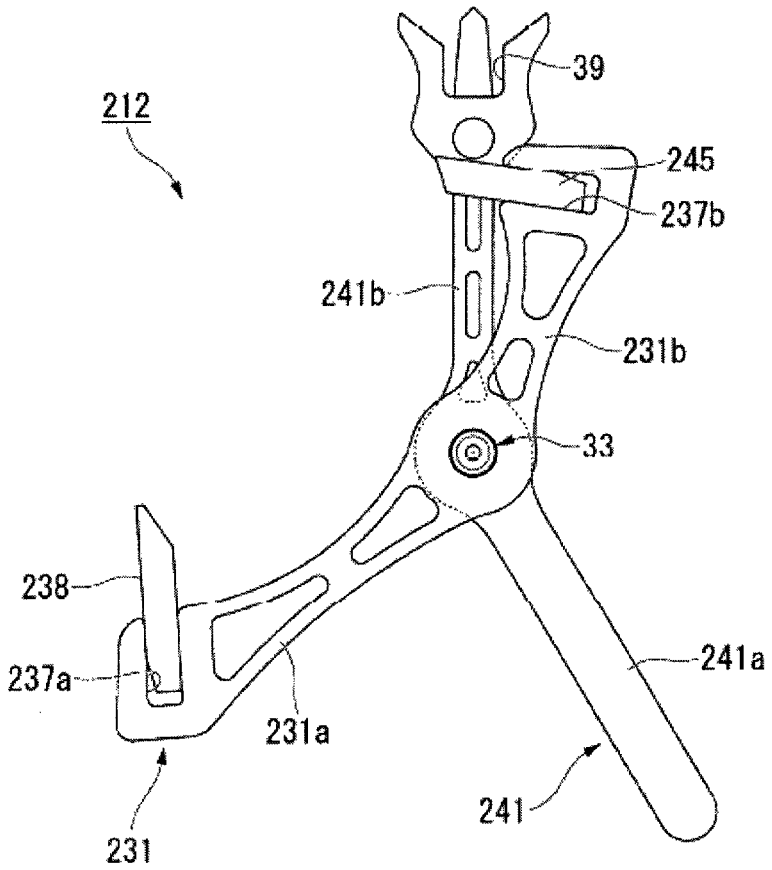
FIG. 16 is a plan view of a pallet fork according to the second embodiment.

FIG. 15 is a perspective view of an escapement 201 according to a second embodiment, and FIG. 16 is a plan view of a pallet fork 212 according to the second embodiment.

Subsequently, the escapement 201 according to the second embodiment will be described.

The escapement 1 according to the first embodiment is configured so that the pallet fork 12 is formed of the pallet fork body 32 (refer to FIG. 2).

In contrast, the escapement 201 according to the second embodiment is different from that of the first embodiment in that the pallet fork 212 is formed of a first pallet fork body 231 and a second pallet fork body 241 as illustrated in FIG. 15. Hereinafter, description of configuring elements which are the same as those of the first embodiment will be omitted, and only different elements will be described.

As illustrated in FIG. 16, the pallet fork 212 includes a first pallet fork body 231 formed in a substantially L-shape in a plan view by two pallet beams 231*a* and 231*b*, a second pallet fork body 241 formed in a substantially L-shape in a plan view by two pallet beams 241*a* and 241*b*, and a pallet staff 33 pivotally supporting the first pallet fork body 231 and the second pallet fork body 241.

As illustrated in FIG. 15, the first pallet fork body 231 and the second pallet fork body 241 are disposed to be overlapped with each other in the axial direction of the pallet staff 33 and the balance staff 51. Specifically, the first pallet fork body 231 is disposed at a position corresponding to the escape wheel 11 in the axial direction, and the second pallet fork body 241 is disposed at a position corresponding to an engagement portion with the first impulse pin 57 of the double roller 53, which is the further rear side (lower side in FIG. 15) of the movement 101 (refer to FIG. 1) than the first pallet fork body 231.

As illustrated in FIG. 16, in the distal ends of the two pallet beams 231*a* and 231*b* which form the first pallet fork body 231, slits 237*a* and 237*b* are respectively formed so that the escape wheel 11 (refer to FIG. 15) side is open. An exit pallet 238 is fixed to the slit 237*a* of one side pallet beam 231*a*, and an entry pallet 245 is fixed to the slit 237*b* of the other side pallet beam 231*b*, respectively by adhesives, for example. The exit pallet 238 and the entry pallet 245 are respectively formed in a square pillar shape, and are respectively in a state of protruding toward the escape wheel 11 from the distal ends of the pallet beams 231*a* and 231*b*. Here, the first pallet fork body 231 is disposed at a position corresponding to the escape wheel 11 in the axial direction. Accordingly, the exit pallet 238 and the entry pallet 245 can respectively disengage from the tooth portion 23 of the escape wheel 11, even without being respectively caused to protrude in the axial direction.

As illustrated in FIG. 15, one side pallet beam 241*a* between the two pallet beams 241*a* and 241*b* which form the second pallet fork body 241 is arranged between the banking pins 61*a* and 61*b*, and comes into contact with the banking pins 61*a* and 61*b* by the pallet fork 212 pivotally moving. This regulates the pivotal movement amount of the pallet fork 212.

In addition, as illustrated in FIG. 16, the pallet receptacle 39 is integrally molded in the distal end of the other side pallet beam 241*b*.

According to the second embodiment, the first pallet fork body 231 holding the entry pallet 245 and the exit pallet 238 and the second pallet fork body 241 which can come into contact with the first impulse pin 57 are disposed to be overlapped with each other in the axial direction of the balance staff 51. In this manner, it is possible to arrange the first pallet fork body 231 at the position corresponding to the tooth portion 23 of the escape wheel 11 and to arrange the second pallet fork body 241 at the position corresponding to the first impulse pin 57 in the axial direction. This can prevent the entry pallet 245 and the exit pallet 238 held by the first pallet fork body 231 from being lengthened in the axial direction. Accordingly, it is possible to decrease the weight of the entry pallet 245 and the exit pallet 238, and it is possible to reduce the bending moment acting on the entry pallet 245 and the exit pallet 238 when the entry pallet 245 and the exit pallet 238 come into contact with the tooth portion 23 of the escape wheel 11. Therefore, it is possible to provide the excellent escapement 201 which can achieve both of the decreased weight and the improved durability.

Third Embodiment

Figure 17:
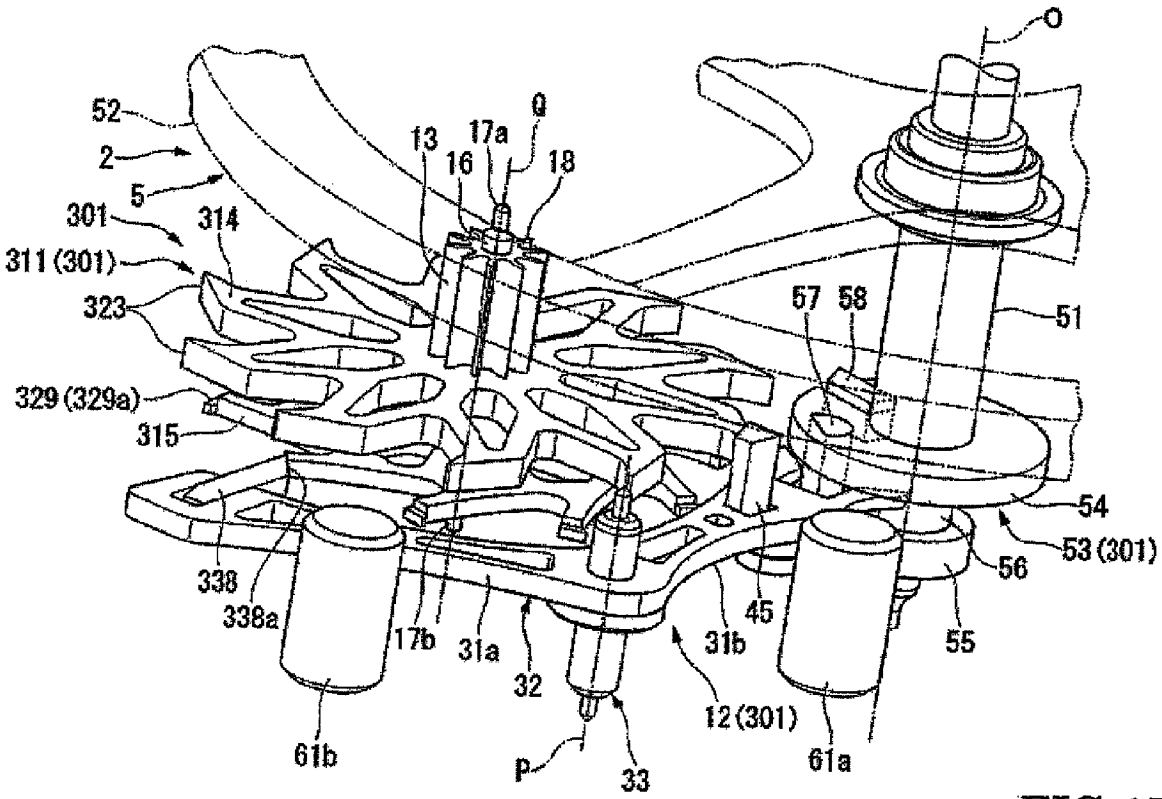
FIG. 17 is a perspective view of an escapement according to a third embodiment.
Figure 18:
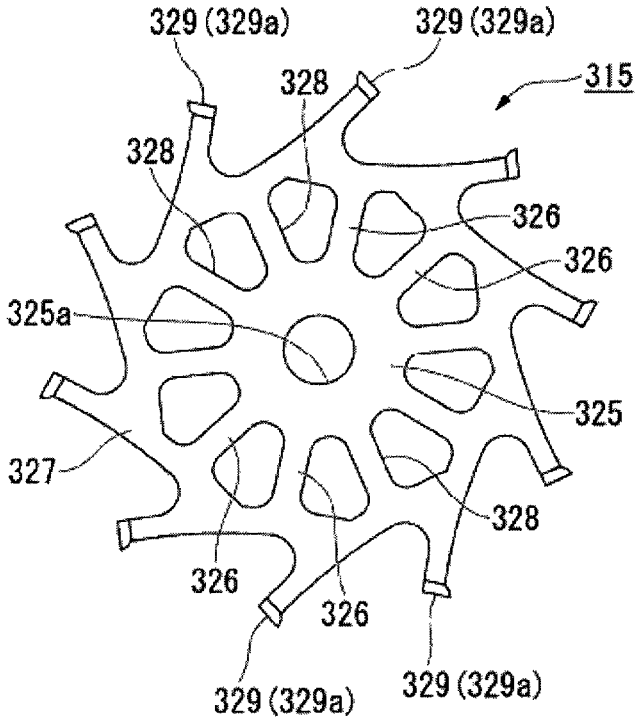
FIG. 18 is a plan view of a second escape wheel portion according to the third embodiment.

FIG. 17 is a perspective view of an escapement 301 according to a third embodiment, and FIG. 18 is a plan view of a second escape wheel portion 315 according to the third embodiment.

Subsequently, the escapement 301 according to the third embodiment will be described.

The escapement 1 according to the first embodiment is configured so that the escape wheel 11 is formed of one escape wheel portion 14 (refer to FIG. 2).

In contrast, the escapement 301 according to the third embodiment is different from that of the first embodiment in that an escape wheel 311 is formed of a first escape wheel portion 314 and a second escape wheel portion 315 as illustrated in FIG. 17. Hereinafter, description of configuring elements which are the same as those of the first embodiment will be omitted, and only different elements will be described.

As illustrated in FIG. 17, the escape wheel 311 includes the first escape wheel portion 314, and the second escape wheel portion 315 which is disposed to be overlapped with the first escape wheel portion 314 in the axial direction, and which is the further rear side (lower side in FIG. 17) of the movement 101 (refer to FIG. 1) than the first escape wheel portion 314.

The first escape wheel portion 314 has first tooth portion 323. The first escape wheel portion 314 in the third embodiment has a shape which is the same as that of the escape wheel portion 14 (refer to FIG. 3) in the first embodiment, and thus description thereof will be omitted.

As illustrated in FIG. 18, the second escape wheel portion 315 is a member formed of a metallic material or a material having crystal orientation such as single crystal silicon, for example, and is formed by means of electroforming, a LIGA process in which an optical method such as photolithography is incorporated, DRIE or MIM. A manufacturing method of the second escape wheel portion 315 is not limited to the above-described methods. For example, the second escape wheel portion 315 may be formed by performing mechanical processing on the metallic material. The second escape wheel portion 315 has a substantially annular-shaped hub portion 325 which is inserted into the axle portion 13 (refer to FIG. 17). A through-hole 325*a* fitted to the axle portion 13 is formed in the hub portion 325.

Multiple (ten in the present embodiment) spokes 326 extending in the radial direction are integrally and radially molded in an outer peripheral portion of the hub portion 325. A substantially annular rim portion 327 is integrally molded in a distal end of the spoke 326. In this manner, multiple (ten) openings 328 are formed along the circumferential direction in the second escape wheel portion 315.

In addition, in the outer peripheral portion of the rim portion 27, multiple (ten in the present embodiment) second tooth portions 329 which are formed in a special hook shape in a plan view are formed to protrude radially outward. An exit pallet 338 (refer to FIG. 17) of the pallet fork 12 is configured to come into contact with the distal end of the multiple second tooth portions 329.

An impact surface 329*a* is formed in the distal end of the second tooth portion 329. The impact surface 329*a* is flatly formed so as to intersect a protruding direction of the second tooth portion 329. As illustrated in FIG. 17, the impact surface 329*a* is configured so that in response to the rotation of the escape wheel 311, the second tooth portion 329 of the escape wheel 311 slides on a sliding surface 338*a* of an exit pallet 338 and thereafter the exit pallet 338 slides thereon.

The second escape wheel portion 315 is press-fitted to the axle portion 13, for example, in a state where phases thereof are aligned with each other so that the second tooth portion 329 of the second escape wheel portion 315 is located between the two adjacent first tooth portion 323 of the first escape wheel portion 314. The second escape wheel portion 315 may fixedly adhere to the axle portion 13 by an adhesive, for example.

The exit pallet 338 is formed of a ruby, for example, in a square pillar shape, and protrudes toward the escape wheel 11 from the distal end of the pallet beam 31*a*. Here, the second escape wheel portion 315 is disposed at a position corresponding to the pallet fork 12 in the axial direction. Accordingly, the exit pallet 338 can disengage from the second tooth portion 329 of the second escape wheel portion 315 even without being caused to protrude in the axial direction.

According to the third embodiment, the first escape wheel portion 314 and the second escape wheel portion 315 are disposed to be overlapped with each other in the axial direction, the second impulse pin 58 can come into contact with the first tooth portion 323 of the first escape wheel portion 314, and the exit pallet 338 can disengage from the second tooth portion 329 of the second escape wheel portion 315. Therefore, it is possible to arrange the second impulse pin 58 at the position corresponding to the first tooth portion 323 of the first escape wheel portion 314 and to arrange the exit pallet 338 at the position corresponding to the second tooth portion 329 of the second escape wheel portion 315 in the axial direction. This can prevent the second impulse pin 58 and the exit pallet 338 from being lengthened in the axial direction. Accordingly, it is possible to decrease the weight of the second impulse pin 58 and the exit pallet 338, and it is possible to reduce the bending moment acting on the second impulse pin 58 when the second impulse pin 58 comes into contact with the first tooth portion 323 of the escape wheel 311, and the bending moment acting on the exit pallet 338 when the exit pallet 338 comes into contact with the second tooth portion 329 of the escape wheel 311.

In addition, the second escape wheel portion 315 is further decreased in diameter than the first escape wheel portion 314. In this manner, it is possible to increase the torque generated in the pallet fork 12 as compared to the torque generated in the second escape wheel portion 315. In addition, the decreased weight of the entry pallet 45 and the exit pallet 338 can reduce the moment of inertia of the pallet fork 12. Therefore, when the energy is provided by applying the impact to the first impulse pin 57 from the escape wheel 311 via the pallet fork 12, it is possible to further improve the energy transmission efficiency.

In addition, the first tooth portion 323 of the first escape wheel portion 314 and the second tooth portion 329 of the second escape wheel portion 315 can be adapted to have different shapes which are suitable for the respective tooth portions. Therefore, it is possible to improve strength of the first tooth portion 323 of the first escape wheel portion 314 and the second tooth portion 329 of the second escape wheel portion 315.

In addition, the first tooth portion 323 of the first escape wheel portion 314 with which the second impulse pin 58 comes into contact and the second tooth portion 329 of the second escape wheel portion 315 from which the exit pallet 338 disengages are disposed at positions respectively deviated from each other in the axial direction. Therefore, for example, even when the exit pallet 338 and the second tooth portion 329 of the second escape wheel portion 315 are lubricated, it is possible to reliably suppress the oil spreading to the contact portion between the first impulse pin 57 and the pallet fork 12, and it is also possible to reliably suppress the oil spreading to the second impulse pin 58.

In addition, the second tooth portion 329 slides on the sliding surface 338*a* of the exit pallet 338, and thereafter the exit pallet 338 further slides on the impact surface 329*a* of the second tooth portion 329. In this manner, it is possible to apply a large torque to the balance 5 via the pallet fork 12. Consequently, the energy transmitted to the balance 5 can be further improved by the escape wheel 311 which has both of the first tooth portion 323 and the second tooth portion 329 which can apply a direct impact to the second impulse pin 58.

Modification Example of Third Embodiment

Figure 19:
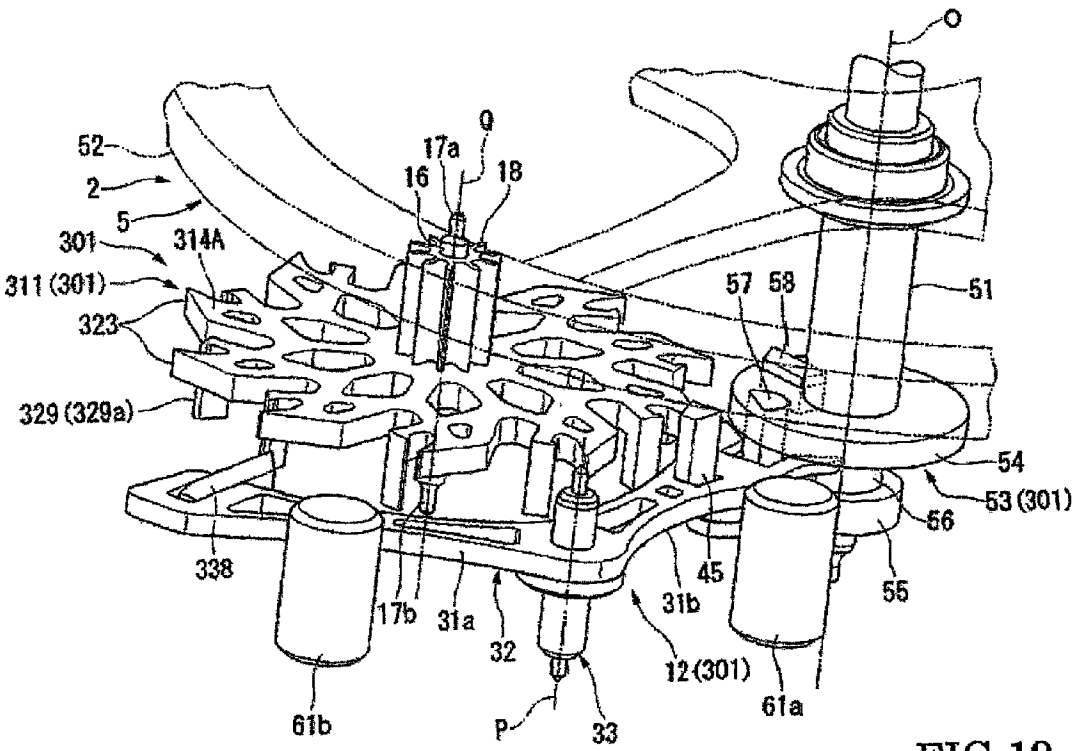
FIG. 19 is a perspective view of an escapement according to a modification example of the third embodiment.

FIG. 19 is a perspective view of the escapement 301 according to a modification example of the third embodiment.

Subsequently, the escapement 301 according to the modification example of the third embodiment will be described.

In the escapement 301 according to the third embodiment, the escape wheel 11 includes the first escape wheel portion 314 and the second escape wheel portion 315. The first tooth portion 323 which disengages from the entry pallet 45 is formed in the first escape wheel portion 314, and the second tooth portion 329 which disengages from the exit pallet 338 is formed in the second escape wheel portion 315.

In contrast, as in the escapement 301 according to the modification example of the third embodiment illustrated in FIG. 19, the escape wheel 11 may include an escape wheel portion 314A having the first tooth portion 323, and the second tooth portion 329 may be integrally formed with the escape wheel portion 314A. Hereinafter, description of configuring elements which are the same as those of the third embodiment will be omitted, and only different elements will be described.

The escape wheel portion 314A has a first tooth portion 323 and a second tooth portion 329. The second tooth portion 329 has a special hook shape in a plan view, and is formed in a pillar shape extending toward the rear side (lower side in FIG. 19) of the movement 101 (refer to FIG. 1) along the axial direction of the escape wheel 11 (that is, the axial direction of the balance staff 51). The second tooth portion 329 is disposed at a position deviated in the further CW direction than the first tooth portion 323, which is the further radially inner side from the distal end of the first tooth portion 323, and is configured so that the exit pallet 338 of the pallet fork 12 comes into contact therewith. Similar to the third embodiment, the impact surface 329*a* is formed in the distal end of the second tooth portion 329. An operation effect of the impact surface 329*a* is the same as that of the third embodiment, and thus, description thereof will be omitted.

According to the modification example of the third embodiment, the second tooth portion 329 extends along the axial direction. Therefore, as compared to a case of forming the second tooth portion 329 as a gear, it is possible to decrease the weight. This can reduce the moment of inertia of the escape wheel 311. Accordingly, it is possible to improve the energy transmission efficiency from the escape wheel 311 to the balance 5.

In addition, it is possible to easily set the separating distance of the second tooth portion 329 by adjusting the thickness of the second tooth portion 329. Therefore, it is possible to easily ensure the clearance between the exit pallet 338 and the second tooth portion 329. Accordingly, it is possible to provide the escape wheel 311 which is excellent in design flexibility.

Fourth Embodiment

Figure 20:
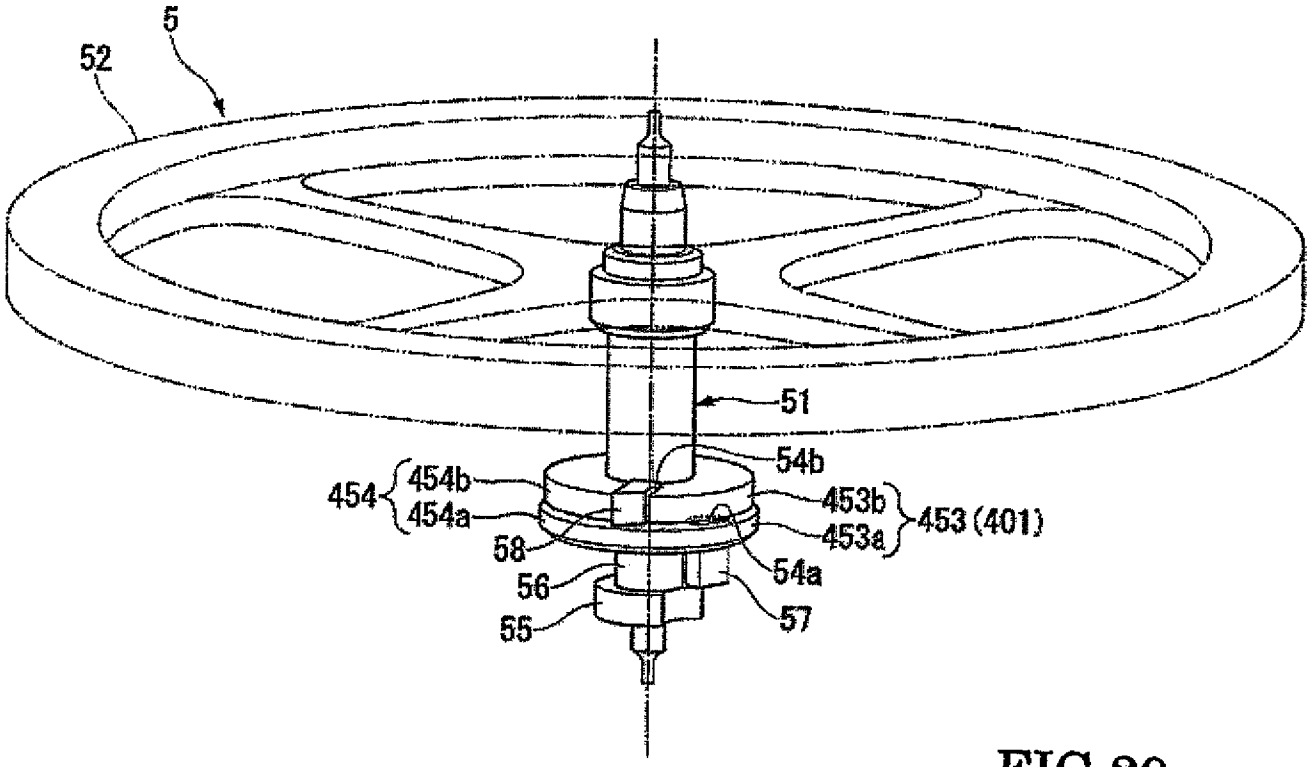
FIG. 20 is a perspective view of a double roller configuring an escapement according to a fourth embodiment.

FIG. 20 is a perspective view of a double roller 453 configuring an escapement 401 according to a fourth embodiment.

The escapement 1 according to the first embodiment is configured so that the double roller 53 includes the cone back face rib 54, the retaining rib 55 and the connection portion 56, and the first impulse pin 57 and the second impulse pin 58 are fixed to the cone back face rib 54 (refer to FIG. 4).

In contrast, the escapement 401 according to the fourth embodiment is different from that of the first embodiment in that as illustrated in FIG. 20, the double roller 453 includes a first double roller body 453*a* and a second double roller body 453*b*, the first impulse pin 57 is fixed to the first double roller body 453*a*, and the second impulse pin 58 is fixed to the second double roller body 453*b*. Hereinafter, description of configuring elements which are the same as those of the first embodiment will be omitted, and only different elements will be described.

The double roller 453 includes the first double roller body 453*a* and the second double roller body 453*b* which is disposed to be overlapped with the first double roller body 453*a* in the axial direction of the balance staff 51, on the further balance wheel 52 side than the first double roller body 453*a*.

The first double roller body 453*a* includes a first cone back face rib 454*a*, the retaining rib 55 which is formed on the further rear side (lower side in FIG. 20) of the movement 101 (refer to FIG. 1) than the first cone back face rib 454*a*, and the connection portion 56 which connects the first cone back face rib 454*a* and the retaining rib 55.

The through-hole 54*a* penetrating in the axial direction is formed in the first cone back face rib 454*a*, and the first impulse pin 57 is fixedly press-fitted thereto, for example.

The second double roller body 453*b* is a disc-shaped member and entirely serves as a second cone back face rib 454*b*. The slit 54*b* extending along the radial direction is formed in the second cone back face rib 454*b*. The second impulse pin 58 is inserted into the slit 54*b* from the outside in the radial direction, and is fixed thereto by an adhesive, for example. The first cone back face rib 454*a* and the second cone back face rib 454*b* form a cone back face rib 454 of the double roller 453.

According to the fourth embodiment, the double roller includes the first double roller body 453*a* holding the first impulse pin 57 and the second double roller body 453*b* holding the second impulse pin 58. Therefore, it is possible to distribute the stress when the first impulse pin 57 comes into contact with the pallet fork 12 and the stress when the second impulse pin 58 comes into contact with the tooth portion 23 of the escape wheel 11, respectively to the first double roller body 453*a* and the second double roller body 453*b*. In addition, for example, even when the first impulse pin 57 and the second impulse pin 58 are fixed to the double roller 453 by way of press-fitting and further the double roller 453 is fixed to the balance staff 51 by way of the press-fitting, it is possible to distribute the stress generated during the press-fitting to the first double roller body 453*a* and the second double roller body 453*b*. Accordingly, it is possible to ensure the rigidity of the double roller 453, and it is possible to provide the escapement 401 which is excellent in the durability.

The technical scope of the present invention is not limited to the above-described embodiments, but can be additionally modified in various ways without departing from the spirit of the present invention.

The shape or the material of the escape wheels 11 and 311, the pallet forks 12 and 212, the double rollers 53 and 453, the entry pallets 45 and 245, the exit pallets 38, 238 and 338, the first impulse pins 57, and the second impulse pins 58 is not limited to that of the respective embodiments.

In addition, the fixing method of the entry pallets 45 and 245, the exit pallets 38, 238, and 338, the first impulse pin 57, and the second impulse pin 58 is not limited to that of the respective embodiments.

In addition, in the respective embodiments, the first pallet in claims has been described as the entry pallets 45 and 245, and the second pallet in claims has been described as the exit pallets 38, 238, and 338. However, the first pallet in claims may be the exit pallets 38, 238, and 338, and the second pallet in claims may be the entry pallets 45 and 245.

In addition, without departing from the spirit of the present invention, it is possible to appropriately replace the configuring elements in the above-described embodiments with known configuring elements.

What is claimed is:

1. An escapement comprising:

an escape wheel;

a double roller that is disposed in a balance pivotally moving around a balance staff; and a pallet fork that can pivotally move around a pallet staff, wherein the double roller includes a first impulse pin which comes into contact with the pallet fork in response to a pivotal movement of the double roller and causes the pallet fork to pivotally move around the pallet staff, and a second impulse pin which can come into contact with a tooth portion of the escape wheel, and wherein the pallet fork includes two pallets.

2. The escapement according to claim 1, wherein the two pallets are a first pallet and a second pallet which can disengage from the tooth portion of the escape wheel in response to a pivotal movement of the pallet fork and cause the escape wheel to be rotated and stopped, wherein a distal end of the second pallet has a sliding surface which intersects a circumferential direction of the escape wheel and on which the tooth portion of the escape wheel is slidable during rotation of the escape wheel, wherein when the double roller pivotally moves to one side in the circumferential direction of the balance staff, the first pallet and the escape wheel are disengaged from each other, and the tooth portion of the escape wheel and the second impulse pin come into contact with each other, and wherein when the double roller pivotally moves to the other side in the circumferential direction, the second pallet and the escape wheel are disengaged from each other, and the tooth portion of the escape wheel slides on the sliding surface.

3. The escapement according to claim 2, wherein the pallet fork includes a first pallet fork body which holds the first pallet and the second pallet, and a second pallet fork body which is disposed to be overlapped with the first pallet fork body in an axial direction of the balance staff and can come into contact with the first impulse pin.

4. The escapement according to claim 3, wherein the escape wheel includes a first escape wheel portion and a second escape wheel portion which is disposed to be overlapped with the first escape wheel portion in the axial direction of the balance staff, wherein the tooth portion of the escape wheel includes first tooth portion which is formed in the first escape wheel portion and second tooth portion which is formed in the second escape wheel portion, and wherein at least the second impulse pin can come into contact with the first tooth portion, and at least the second pallet can disengage from the second tooth portion.

5. The escapement according to claim 3, wherein the tooth portion of the escape wheel has first tooth portion, and second tooth portion which extends along the axial direction of the balance staff, and wherein at least the second impulse pin can come into contact with the first tooth portion, and at least the second pallet can disengage from the second tooth portion.

6. The escapement according to claim 4, wherein the second tooth portion has an impact surface on which the second pallet slides after the second tooth portion of the escape wheel slides on the sliding surface of the second pallet in response to the rotation of the escape wheel.

7. The escapement according to claim 5, wherein the second tooth portion has an impact surface on which the second pallet slides after the second tooth portion of the escape wheel slides on the sliding surface of the second pallet in response to the rotation of the escape wheel.

8. The escapement according to claim 2, wherein the escape wheel includes a first escape wheel portion and a second escape wheel portion which is disposed to be overlapped with the first escape wheel portion in the axial direction of the balance staff, wherein the tooth portion of the escape wheel includes first tooth portion which is formed in the first escape wheel portion and second tooth portion which is formed in the second escape wheel portion, and wherein at least the second impulse pin can come into contact with the first tooth portion, and at least the second pallet can disengage from the second tooth portion.

9. The escapement according to claim 2, wherein the tooth portion of the escape wheel has first tooth portion, and second tooth portion which extends along the axial direction of the balance staff, and wherein at least the second impulse pin can come into contact with the first tooth portion, and at least the second pallet can disengage from the second tooth portion.

10. The escapement according to claim 1, wherein the double roller includes a first double roller body which holds the first impulse pin, and a second double roller body which is disposed to be overlapped with the first double roller body in the axial direction of the balance staff and holds the second impulse pin.

11. The escapement according to claim 1, wherein the pallet fork includes a pallet receptacle whose inner surface can come into contact with the first impulse pin, and a blade tip which extends from an inner side of the pallet receptacle toward the double roller, and wherein a retaining rib with which the blade tip comes into sliding contact is disposed in the double roller.

12. The escapement according to claim 1, wherein the tooth portion of the escape wheel has a contact surface which comes into contact with the pallet, wherein the pallet has an engagement surface which engages with the contact surface of the escape wheel, wherein when viewed from the axial direction of a rotation center of the escape wheel, a straight line connecting a central axis of the pallet staff with a tooth tip of the tooth portion of the escape wheel is set to be a first straight line, and a straight line orthogonal to the first straight line is set to be a second straight line, and wherein when the contact surface of the escape wheel and the engagement surface of the pallet engage with each other, the engagement surface of the pallet is tilted with respect to the second straight line at a predetermined angle in a rotating direction of the escape wheel.

13. A timepiece movement comprising:

the escapement according to claim 1.

14. A timepiece comprising:

the timepiece movement according to claim 11.

* * * * *